US010703108B2

(12) United States Patent
Arima et al.

(10) Patent No.: US 10,703,108 B2
(45) Date of Patent: Jul. 7, 2020

(54) INKJET RECORDING APPARATUS

(71) Applicant: Hitachi Industrial Equipment Systems Co., Ltd., Chiyoda-ku, Tokyo (JP)

(72) Inventors: Takahiro Arima, Tokyo (JP); Tsuneaki Takagishi, Tokyo (JP); Manabu Kato, Tokyo (JP); Shoki Yamaguchi, Tokyo (JP); Satoshi Hasegawa, Tokyo (JP); Mamoru Okano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/243,179

(22) Filed: Jan. 9, 2019

(65) Prior Publication Data

US 2019/0217627 A1 Jul. 18, 2019

(30) Foreign Application Priority Data

Jan. 15, 2018 (JP) ..... 2018-004083

(51) Int. Cl.
*B41J 2/175* (2006.01)
*B41J 2/085* (2006.01)
(Continued)

(52) U.S. Cl.
CPC ..... *B41J 2/17563* (2013.01); *B41J 2/08* (2013.01); *B41J 2/085* (2013.01); *B41J 2/09* (2013.01);
(Continued)

(58) Field of Classification Search
CPC ..... B41J 2/075; B41J 2/08; B41J 2/085; B41J 2/09; B41J 2/125; B41J 2/135; B41J 2/17563; B41J 2/18
See application file for complete search history.

(56) References Cited

U.S. PATENT DOCUMENTS 4,328,505 A * 5/1982 Jinnai ..... B41J 2/115 347/80
4,435,720 A * 3/1984 Horike ..... B41J 2/12 347/6
(Continued)

FOREIGN PATENT DOCUMENTS

JP 10-264410 A 10/1998
JP 2010-12710 A 1/2010

*Primary Examiner* — Anh T Vo
(74) *Attorney, Agent, or Firm* — Crowell & Moring LLP

(57) ABSTRACT

An inkjet recording apparatus, which can enhance the reliability of the phase search result to detect the optimal timing when the ink particles are electrically charged by the electrification electrode and secure the stable printing quality, is provided. The inkjet recording apparatus includes an ink receptacle in which a printing ink for an object to be printed is received; a nozzle which is connected to the ink receptacle and from which the ink fed under pressure is discharged; an electrification electrode to make ink particles discharged from the nozzle electrically charged; an electrification signal generation unit to generate an electrification signal to make the electrification electrode electrically charged; deflection electrodes to make the ink particles electrically charged by the electrification electrode deflect; a gutter to recover the ink unused for the printing; and a control unit to control operations of the inkjet recording apparatus as a whole; a first electric charge detection section to detect an amount of electric charge in accordance with the electrically charged ink particles between the electrification electrode and the deflection electrodes; and a second electric charge detection section to detect an amount of electric charge of the ink flowing within the gutter.

13 Claims, 14 Drawing Sheets

(51) Int. Cl.

| | |
|---|---|
| ***B41J 2/09*** | (2006.01) |
| ***B41J 2/125*** | (2006.01) |
| ***B41J 2/08*** | (2006.01) |
| ***B41J 2/135*** | (2006.01) |
| ***B41J 2/18*** | (2006.01) |

(52) U.S. Cl.
CPC ..... *B41J 2/125* (2013.01); *B41J 2/135* (2013.01); *B41J 2/18* (2013.01)

(56) References Cited

U.S. PATENT DOCUMENTS 4,612,553 A * 9/1986 Kohler ..... B41J 2/12
347/6
8,888,209 B2 * 11/2014 Pouzet ..... B41J 2/02
347/7

* cited by examiner

INKJET RECORDING APPARATUS

BACKGROUND

The present invention relates to an inkjet recording apparatus which does the printing by jetting ink from a nozzle.

RELATED ART

As one of the closest prior arts in the present technical field, Japanese Patent Unexamined Application Publication No. Hei 10-264410 is exemplified herein, in which there is disclosure on an inkjet recoding apparatus including an ink receptacle to store ink; a feed pump to feed ink to a recording head from the ink receptacle; a recovery pump to recover ink from the recording head to the ink receptacle; and an ink feed line and an ink recover line interconnecting the ink receptacle and the recording head, in which the recording head is provided with a nozzle to jet ink fed from the feed pump as ink particles; an electrification electrode to make the ink particles electrically charged; deflection electrodes to make the electrically charged ink particles deflect by an electrostatic field; and a gutter to catch unused ink, the inkjet recording apparatus being characterized in the recovery pump being provided within the recording head and being provided with a section to measure the amount of electric charge of the ink caught by the gutter and to vary an amount of the ink to be recovered by the recovery pump based on the result of the measured amount of electric charge.

Further, as the other of the closest prior arts in the present technical field, Japanese Patent Unexamined Application Publication No. 2010-12710 is exemplified herein, in which there is disclosure on an inkjet recording apparatus including an ink receptacle to retain a printing ink; a feed pump to suction the ink through a piping path from the ink receptacle and to feed the ink to an ink discharge nozzle under pressure; and a pressure reducing valve disposed between the feed pump and the ink discharge nozzle to regulate a pressure applied to the ink within the piping path, the inkjet recording apparatus being characterized in the pressure reducing valve being provided with a valve body and a valve seat; regulating the amount of ink within the piping path by bringing the valve body and the valve seat into contact with each other or detach them from each other so as to regulate a pressure applied to the ink within the piping path; and provided at the abutment section between the valve body and the valve seat with a seal member having compression recovery property.

With the so-called continuous type inkjet recording apparatuses disclosed in Japanese Patent Unexamined Application Publication Nos. Hei 10-264410 and 2010-12710, the ink particles are electrically charged by the electrification electrode according to the contents to be printed and are used for printing with the direction in which they fly varied upon passing through the electrostatic deflection field between the deflection electrodes. On the other hand, the ink particles which are not electrically charged by the electrification electrode are not deflected by the deflection electrodes, but go straight to be received in the gutter; and pass within the ink recovery path by the suction force of the ink recovery pump so as to return to the ink receptacle for recycling or recirculation.

Then, the gutter is provided with a phase sensor to perform phase search for detecting the optimum timing when the ink particles are electrically charged by the electrification electrode. With such phase sensor provided on the gutter, since there arises an interval between the electrification electrode and the gutter, it unavoidably takes time to feed back the detection result by the phase sensor for the electric charge timing of the electrification electrode. Thus, under the conditions in practical use such as when the ambient temperature changes or when engaged in high-speed printing in which changing the ink into particles tends to be unstable, there are cases where the stable printing quality becomes hard to be secured.

Further, the electric charge applied to the ink particles is made extremely small in terms of an amount of electric charge lest that they might fly over the gutter under the influence of the electric field between the deflection electrodes, so that there have been cases where it is faced with difficulty in the phase sensor detecting an amount of electric charge under the influence of noises according to the surroundings in practical use, which leads to detection failure.

SUMMARY OF THE INVENTION

The present invention is to provide an inkjet recording apparatus which can enhance the reliability of the phase search result and secure the stable printing quality.

In view of the above prior arts and technical problem, the inkjet recording apparatus according to the present invention is characterized in including: an ink receptacle in which a printing ink for an object to be printed is received; a nozzle which is connected to the ink receptacle and from which the ink fed under pressure is discharged; an electrification electrode to make ink particles discharged from the nozzle electrically charged; an electrification signal generation unit to generate an electrification signal to make the electrification electrode electrically charged; deflection electrodes to make the ink particles electrically charged by the electrification electrode deflect; a gutter to recover the ink unused for the printing; and a control unit to control operations of the inkjet recording apparatus as a whole; a first electric charge detection section to detect an amount of electric charge in accordance with the electrically charged ink particles between the electrification electrode and the deflection electrodes; and a second electric charge detection section to detect an amount of electric charge of the ink flowing within the gutter.

According to the present invention, it is possible to provide an inkjet recording apparatus which can enhance the reliability of the phase search result and secure the stable printing quality.

DETAILED DESCRIPTION OF THE PREFERRED EMBODIMENTS

Hereafter, the preferred examples of the present invention are described with reference to the accompanying drawings.

First Example

Figure 1:
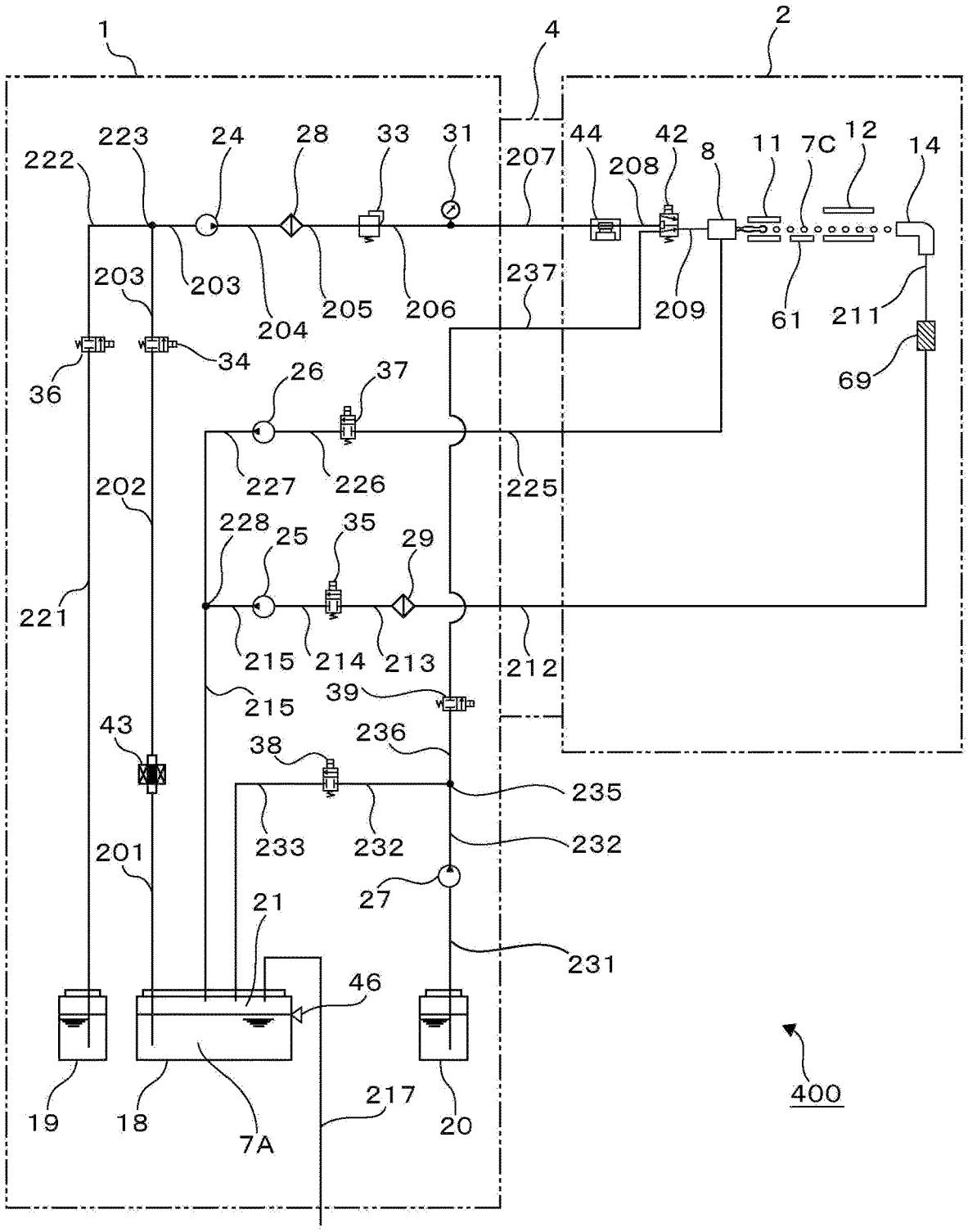
FIG. 1 is a view illustrating the paths arrangement of the inkjet recording apparatus according to a first embodiment.

FIG. 1 is a view illustrating the entire paths arrangement of an inkjet recording apparatus 400 according to the present example. With reference to FIG. 1, the inkjet recording apparatus 400 is provided with a main body 1 and a printing head 2 in the exterior, in which the main body 1 and the printing head 2 are interconnected with each other through a conducting pipe 4.

To begin with, explanation is given on the ink feeding paths of the inkjet recording apparatus 400 according to the present example. With reference to FIG. 1, the main body 1 is provided with a main ink receptacle 18 to retain a circulating ink 7A therein, in which the main ink receptacle 18 is provided with a liquid surface sensor 46 to detect whether or not the liquid within the main ink receptacle 18 reaches the standard liquid surface level which corresponds to the volume proper enough for such liquid to be retained within the same.

The main ink receptacle 18, in order to grasp the viscosity of the ink 7A within the main ink receptacle 18, is connected through a path 201 to a viscosity meter 43. The viscosity meter 43 is connected through a path 202 to an electromagnetic valve (for feed) 34 to open/close the paths while the electromagnetic valve (for feed) 34 is connected through a path 203 to a pump (for feed) 24 which is used for suctioning and feeding the ink 7A under pressure. Then, the pump (for feed) 24 is connected through a path 204 to a filter (for feed) 28 which removes foreign matters admixed with the ink 7A.

The filter (for feed) 28 is connected through a path 205 to a pressure regulating valve 33 to adjust the ink 7A fed under pressure from the pump (for feed) 24 such that the pressure applied to the ink is adjusted properly for the printing while the pressure regulating valve 33 is provided with a pressure sensor 31 to measure the pressure applied to the ink 7A fed to a nozzle through a path 206. The pressure sensor 31 is connected to a heater 44 which is provided within the printing head 2 through a path 207 passing through the conducting pipe 4 and heats the ink 7A to be fed to the nozzle 8 where necessary. The heater 44 is connected through a path 208 to a switch valve 42 to control whether or not the ink 7A is fed to the nozzle 8.

The switch valve 42 is connected through a path 209 to the nozzle 8 provided with an outlet to discharge the ink 7A. To note, the switch valve 42 is a three-way type electromagnetic valve, to which the path 208 for feeding the ink and a path 237 for washing are connected and which enables the ink and a solvent to be switched over for supply to the nozzle 8. In the direction to which the outlet of the nozzle 8 goes straight, an electrification electrode 11 to apply a predetermined amount of electric charge to the ink particles 7C; a first electric charge detection section (phase sensor A) 61 to measure an amount of electrification (amount of electric charge) of the flying ink particles 7C in a non-contact manner; deflection electrodes 12 to deflect the ink particles 7C used for the printing; and a gutter 14 to catch the ink particles 7C flying straight without being electrically charged and deflected due to being unused for the printing are disposed.

Then, explanation on the ink recovery paths is given as follows. With reference to FIG. 1, the gutter 14 is connected through a path 211 to a second electric charge detection section (phase sensor B) 69 to measure the amount of electrification (amount of electric charge) of the recovered ink. The second electric charge detection section (phase sensor B) 69 is connected through a path 212 passing through the conducting pipe 4 to a filter (for recovery) 29 which is disposed in the main body 1 and removes foreign matters admixed with the ink while the filter (for recovery) 29 is connected through a path 213 to an electromagnetic valve (for recovery) 35 to open/close the paths.

The electromagnetic valve (for recovery) 35 is connected through a path 214 to a pump (for recovery) 25 to suction the ink particles 7C caught by the gutter 14 while the pump (for recovery) 25 is connected through a path 215 to the main ink receptacle 18. Further, the main ink receptacle 18 is connected to an exhaust path 217, and the exhaust path 217 is in communication with the exterior of the main body 1.

Then, explanation is given on the ink feeding paths for replenishment as follows. With reference to FIG. 1, the main body 1 is provided with an auxiliary ink receptacle 19 to retain ink for replenishment therein while the auxiliary ink receptacle 19 is connected through a path 221 to an electromagnetic valve 36 to open/close the path. In turn, the electromagnetic valve 36 is connected through a path 222 to an influx path 223 connected to the ink feeding path 203.

Now, explanation is given on the ink circulation paths. The nozzle 8 provided within the printing head 2 is arranged in the main body 1 through a path 225 passing through the conducting pipe 4 to be connected to an electromagnetic valve 37 to open/close the path in addition to being connected to the ink feeding path 209. The electromagnetic valve 37 is connected through a path 226 to a pump (for circulation) 26 to suction the ink from the nozzle 8. In turn, the pump (for circulation) 26 is connected through a path 227 to an influx path 228 connected to the ink recovery path 215.

Then, explanation is given on the solvent feeding paths for replenishment as follows. With reference to FIG. 1, the main body 1 is provided with a solvent receptacle 20 to retain a solvent for replenishment therein while the solvent receptacle 20 is connected through a path 231 to a pump (for solvent) 27 used to suction and feed the solvent under pressure. The pump (for solvent) 27 is connected through a path 232 to an electromagnetic valve (for solvent) 38 to open/close the path while the electromagnetic valve (for solvent) 38 is connected through a path 233 to the main ink receptacle 18.

Now, explanation is given on the washing paths as follows. With reference to FIG. 1, the pump (for solvent) 27 is connected through a branch path 235 found in the path 232 and a path 236 to an electromagnetic valve (for washing) 39 to open/close the paths. In turn, the electromagnetic valve (for washing) 39 is connected through a path 237 to the switch valve 42 to control whether or not to feed the solvent for washing to the nozzle 8.

Figure 2:
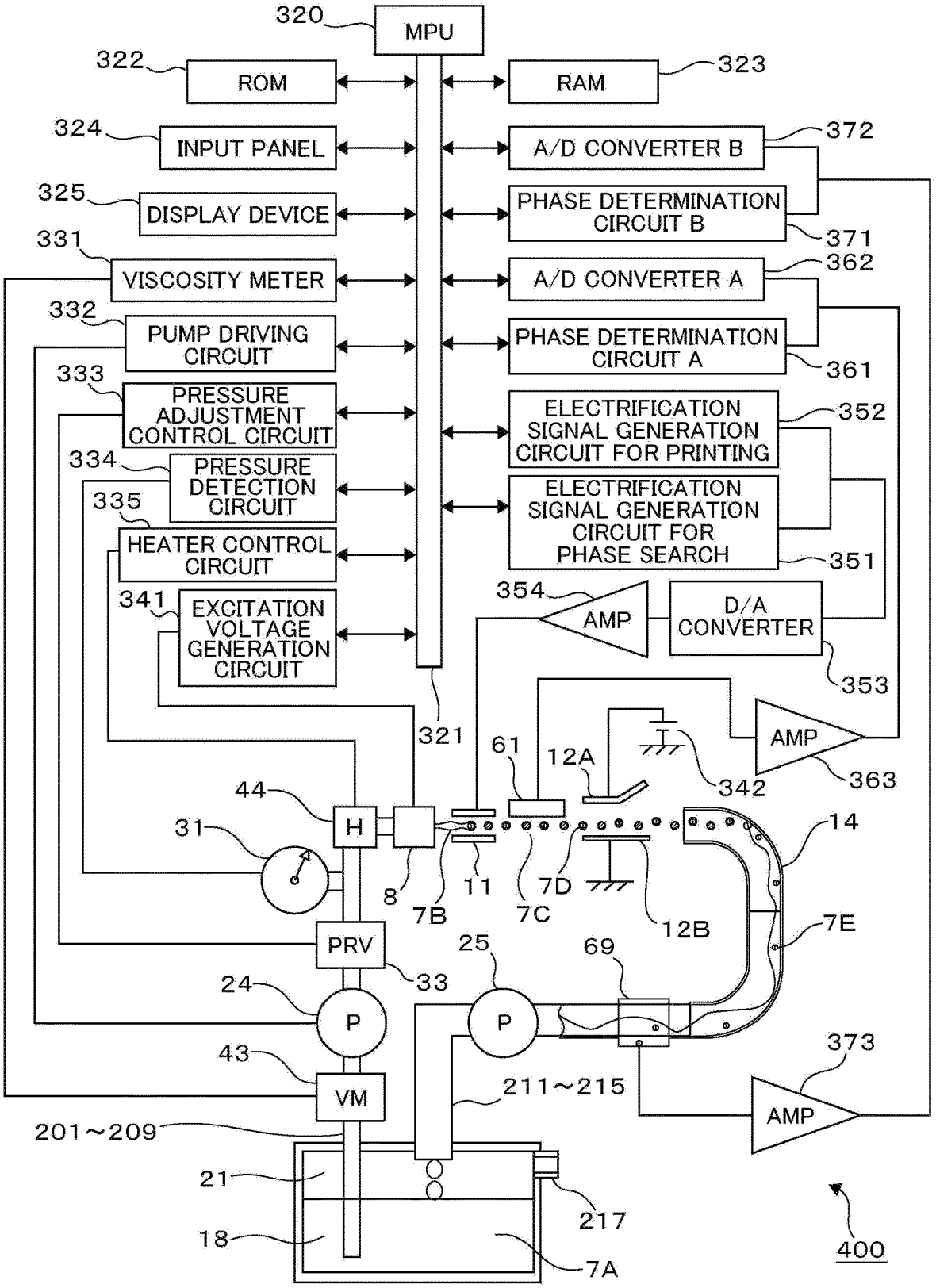
FIG. 2 is a block diagram illustrating the structural arrangement of the inkjet recording apparatus according to the first embodiment.

Subsequently, explanation is given on the functional arrangement of the inkjet recording apparatus 400 according to the present example as follows. FIG. 2 is a functional block diagram of the inkjet recording apparatus 400 according to the present example. With reference to FIG. 2, the reference sign 320 is a micro processing unit (hereinafter, referred to as MPU) which is a control unit to control the inkjet recording apparatus 400 as a whole. The reference sign 321 is a bus line which transmits data signals, address signals and control signals of the MPU 320. The reference sign 322 a read only memory (ROM) to store control programs and data required for operating the MPU 320. The reference sign 323 is a random access memory (RAM) to temporarily store data which the MPU 320 requires for executing the programs. The reference sign 324 is an input panel to input e.g. contents to be printed and set values; the reference sign 325 is a display device to display e.g. the input data and contents to be printed, in which a touch input type display panel arranged such that transparent touch switches are combined with the liquid crystal screen on the surface level is adopted for the input panel 324 and the display device 325.

The inkjet recording apparatus 400 is provided with a main ink receptacle 18; a nozzle 8 to discharge ink 7A; and ink feeding paths 201 to 209 interconnecting the main ink receptacle 18 and the nozzle 8. Then, the inkjet recording apparatus is provided with an electrification electrode 11 which surrounds the location where the ink 7A fed under pressure by an ink feeding pump 24 is jetted from the nozzle 8 into an ink column 7B shape and the tip end of the jetted ink is separated into ink particles 7C; and a first electric charge detection section (phase sensor A) 61 to measure an amount of electrification of the ink particles 7D to which minute electric charge is applied among the flying electrically charged ink particles 7C in a non-contact manner.

Further, the inkjet recording apparatus 400 is provided with deflection electrodes 12 generating electric field deflection (the reference sign 12B being a ground electrode and the reference sign 12A being a plus electrode according to the illustration of FIG. 2) to deflect the flying electrically charged ink particles 7C according to their amount of electrification and to direct the deflected particles to an object to be printed (not shown in the drawing) for printing; a gutter 14 to catch the ink particles 7C unused for printing; a second electric charge detection section (phase sensor B) 69 to generate a phase detection signal according to the amount of electrification of the ink particles 7D to which minute electric charge is applied among the ink particles caught by the gutter 14; an ink recovery pump 25 to recover the ink 7E caught by the gutter 14 into the main ink receptacle 18; and ink recovery paths 211 to 215 interconnecting the gutter 14 and the main ink receptacle 18.

Further, the inkjet recording apparatus 400 is provided with an excitation voltage generation circuit 341 to excite an electrostrictive element 9 (not shown in the drawing) integrated in the nozzle 8 to impart regularity to the timing when the ink column 7B jetted from the nozzle 8 is separated into the ink particles 7C. The inkjet recording apparatus is further provided with an electrification signal generation circuit 352 for printing and an electrification signal generation circuit 351 for phase search; a D/A converter 353 to convert electrification signals in the form of the digitalized signals which are output from such circuits into voltage signals in the form of analog signals; and an amplification circuit 354 to amplify the voltage signals in the form of analog signals which are output from the D/A converter 353 so as to generate electrification voltage to be applied to the electrification electrode 11. To note, the generation of the electrification voltage may be realized by the amount of electrification controlled by the control unit with only the electrification signal generation circuit 352 for printing in use instead of the above arrangement in which the electrification signal generation circuit 352 for printing and the electrification signal generation circuit 351 for phase search are provided. The inkjet recording apparatus 400 is further provided with a deflection voltage generation circuit 342 to generate deflection voltage to be applied to the deflection electrodes 12.

The inkjet recording apparatus 400 is further provided with an amplification circuit 363 to amplify phase detection signals in the form of analog signals output from the first electric charge detection section (phase sensor A) 61; a phase determination circuit A361 to input the amplified phase detection signals and to determine whether or not electrification is optimal; and an A/D converter A362 to input the amplified phase detection signals and to subject them to A/D conversion.

The inkjet recording apparatus 400 is further provided with an amplification circuit 373 to amplify phase detection signals in the form of analog signals output from the second electric charge detection section (phase sensor B) 69; a phase determination circuit B371 to input the amplified phase detection signals and to determine whether or not electrification is optimal; and an A/D converter B372 to input the amplified phase detection signals and to subject them to A/D conversion.

Then, with reference to FIG. 2, a viscosity meter 43 disposed to measure the viscosity of the ink 7A to be fed to the nozzle 8 from the main ink receptacle 18; a pressure regulating valve 33 disposed to adjust the pressure applied to the ink 7A optimally when printing the ink 7A fed under pressure from the ink feeding pump 24; a pressure sensor 31 to check the pressure applied to the ink to be fed to the nozzle 8 which is adjusted by the pressure regulating valve 33; and a heater 44 to heat the ink to an optimal temperature when printing the ink 7A discharged from the nozzle 8 are provided in the ink feeding paths 201 to 209 of the inkjet recording apparatus 400.

Here, the viscosity meter 43 is internally provided with a temperature sensor 43A for viscosity measurement (not shown in the drawing), in which by collating the viscosity measurement result of the ink 7A with the temperature of the ink at the time of measuring the viscosity, it allows the concentration of the ink A to be computed. The viscosity measurement result of the ink by means of the viscosity meter 43 is controlled by a viscosity measurement circuit 331 and the MPU 320, in which such ink viscosity control is performed as in the case where it is determined that the viscosity of the ink is higher, the solvent being replenished from the solvent receptacle 20 so as to make the ink 7A diluted whereas in the case it is determined that the viscosity of the ink is lower, the concentration of the ink being enhanced.

Further, it is arranged such that the pressure sensor 31 transmits its pressure measurement result to a pressure detection circuit 334 and the MPU 320, thereby, the MPU 320 and a pressure adjustment control circuit 333 issuing a command to the effect that the pressure regulating valve 33 is adjusted such that an optimal pressure is gained. Thus, the pressure of the ink 7A to be fed to the nozzle 8 is controlled within a fixed range, which leads to stabilizing the printing behavior of the inkjet recording apparatus 400.

Additionally, the printing head 2 is provided with a temperature sensor for printing environment measurement (not shown in the drawing) to grasp the temperature in the vicinity of the nozzle 8, and the heater 44 is internally provided with a temperature sensor for heating control (not shown in the drawing). The heater 44 performs the heating control of the ink 7A reflecting the control directive of a heater control circuit 335 which is defined based on the temperature measurement result of the temperature sensor for printing environment measurement and that of the temperature sensor for heating control.

In this way, the inkjet recording apparatus 400, in order to perform the stable printing control, is configured to control the viscosity of the ink 7A (or concentration of the ink), the pressure applied thereto and its temperature.

The MPU 320 of the inkjet recording apparatus 400 arranged above control a pump driving circuit 332 through a bus line 321 so as to drive the ink feeding pump 24 and the ink recovery pump 25, thereby, the ink 7A retained within the main ink receptacle 18 being fed to the nozzle 8 with the suction thereof and pressure applied thereto, thereby, the ink 7A being jetted from the nozzle 8 into the ink column 7B shape and the ink particles 7C caught by the gutter 14 being suctioned together with the air so as to be recovered into the main ink receptacle 18. The recovered ink 7A accumulates in the lower part of the main ink receptacle 18, and the air changed into a gas 21 with the solvent substance solved therein passes through the upper part of the receptacle so as to be discharged to the exterior of the main body 1 through the exhaust path 217.

Then, with the ink column 7B jetted from the nozzle 8, its tip end is separated into the ink particles 7C. By exciting the electrostrictive element of the nozzle 8 by the excitation voltage generated by the excitation voltage generation circuit 341 so as to make the ink column 7B vibrate, the timing when the tip end of the ink column 7B is separated into the ink particles 7C can be regulated to a predetermined phase with respect to the excitation voltage.

The amount of electrification of the ink particles 7C is proportional to the amount of electrification of the ink column 7B electrically charged by the potential of the electrification electrode 11 when the ink particles 7C are separated from the tip end of the ink column 7B. The electrification signal generation circuit 352 for printing generates an electrification signal for printing for applying electrification voltage to the electrification electrode 11 such that the amount of electrification required for deflecting the ink particles 7C to a prescribed location when the tip end of the ink column 7B is separated into the ink particles 7C is gained.

The ink particles 7C electrically charged according to the electrification voltage generated based on the electrification signal for printing are electrostatically deflected while they fly between the deflection electrodes 12 so as to be attached to the target location of the object to be printed (not shown in the drawing). The ink particles 7C which are not electrically charged go straight so as to be caught by the gutter 14 for recovery.

The MPU 320 executes phase search for generating the electrification voltage for printing at the timing to bring the proper phase relationship into effect.

Figure 3A:
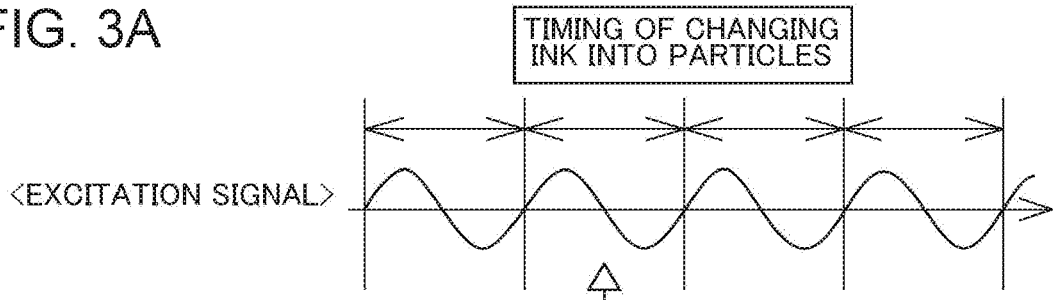
FIGS. 3A to 3C are time charts illustrating the phase relationship between the excitation signal and the electrification voltage for phase search according to the first embodiment.
Figure 3B:
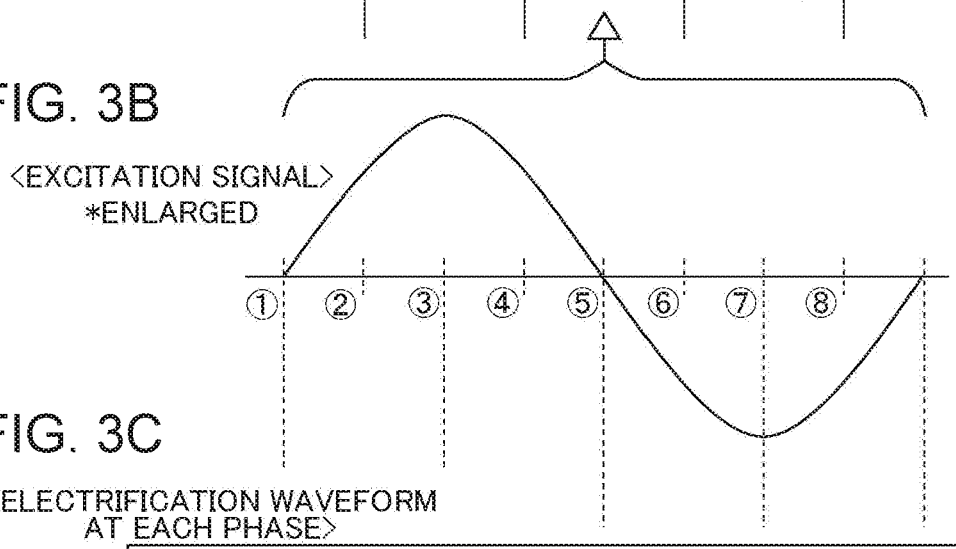
Figure 3C:
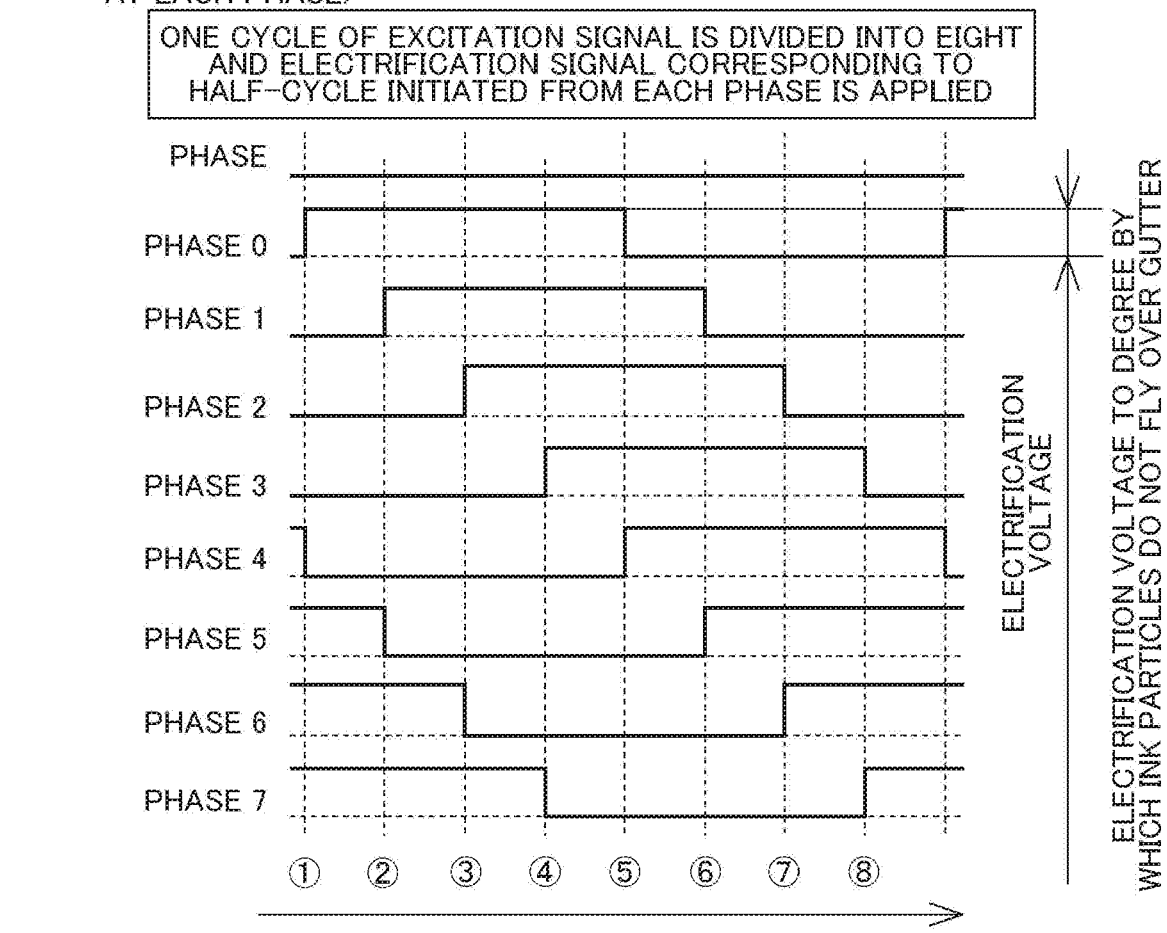

Now, explanation is given on the phase search method of the inkjet recording apparatus 400 according to the present example as follows. FIG. 3 is time charts illustrating the phase relationship between the excitation signal and the electrification voltage for phase search. In FIG. 3, 3(*a*) illustrates the excitation signal on which changing the ink into particles is based and presents an example for detecting the timing of electrification voltage being applied; 3(*b*) is what one cycle of the excitation signal is enlarged; and 3(*c*) illustrates the electrification waveform at each phase when one cycle of the excitation signal is divided into eight and the electrification signal corresponding to the half-cycle initiated from each phase is applied.

With the inkjet recording apparatus 400, in order to detect the optimal timing of the electrification voltage being applied, the electrification voltage to the degree by which the ink particles do not fly over the gutter 14 is applied with electrification phases being displaced to the excitation signal on which changing the ink into particles is based in the state where no printing proceeds (e.g. during an interval between printings), thereby, the amount of the minute electrification charge 58 at each phase being detected. In short, the inkjet recording apparatus conducts phase search with the electrification voltage for phase search generated.

In order to generate such electrification voltage for the phase search, the electrification signal generation circuit 351 for phase search generates the electrification signal for generating plural types of electrification voltages for phase search with their phases changed with respect to the excitation voltage. Such electrification voltages for phase search are so high as for the ink particles 7D electrically charged by the electrification voltages to have a deflection to the degree by which they do not fly over the gutter 14 (to be caught by the gutter 14), and the phase detection signal output from the first electric charge detection section (phase sensor A) 61 according to the amount of the minute electrification charge 58 of the ink particles 7D electrically charged by the electrification voltages is input through the amplification circuit 363 to the phase determination circuit A361 and the A/D converter A362.

Figure 4A:
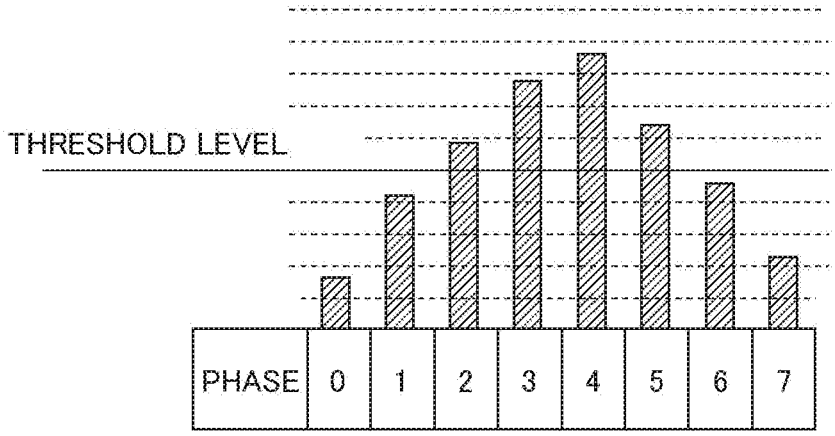
FIGS. 4A to 4C are views illustrating the samples of the phase detection data at the normal changing of the ink into particles and the poor changing of the ink into particles according to the first embodiment.
Figure 4B:
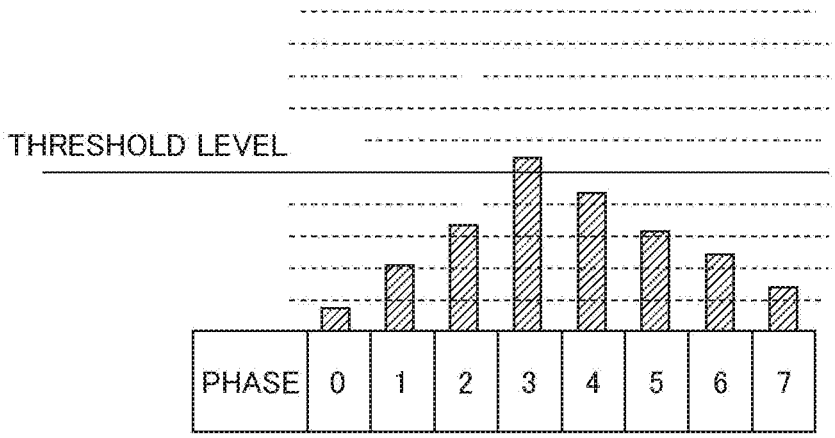
Figure 4C:
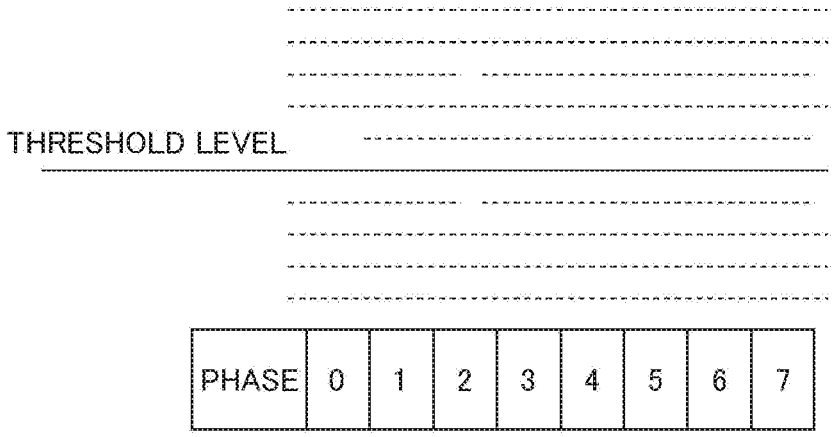

The waveforms of the phase detection signal output from the amplification circuit 363 change e.g. as illustrated in FIG. 4. When the inkjet recording apparatus 400 is in the normal condition, the waveforms of the phase detection signal change as illustrated in FIG. 4(*a*) in accordance with the change of the phases from which the electrification voltages for phase search are generated.

The phase determination circuit A361 to which such phase detection signal is input binarizes the input phase detection signal of each phase by comparing such phase detection signal with a threshold level; defines what goes beyond the threshold level as '1' and what does not go beyond it as '0'; and inputs such result to the MPU 320. The MPU 320 determines that the phase in which the binarized phase detection signal changes from '0' to '1' is the phase optimal to generate the electrification voltage to electrically charge the ink particles 7C and generates such electrification signal for printing as to allow the subsequent electrification voltage for printing to be generated through such optimal phase.

Figure 5:
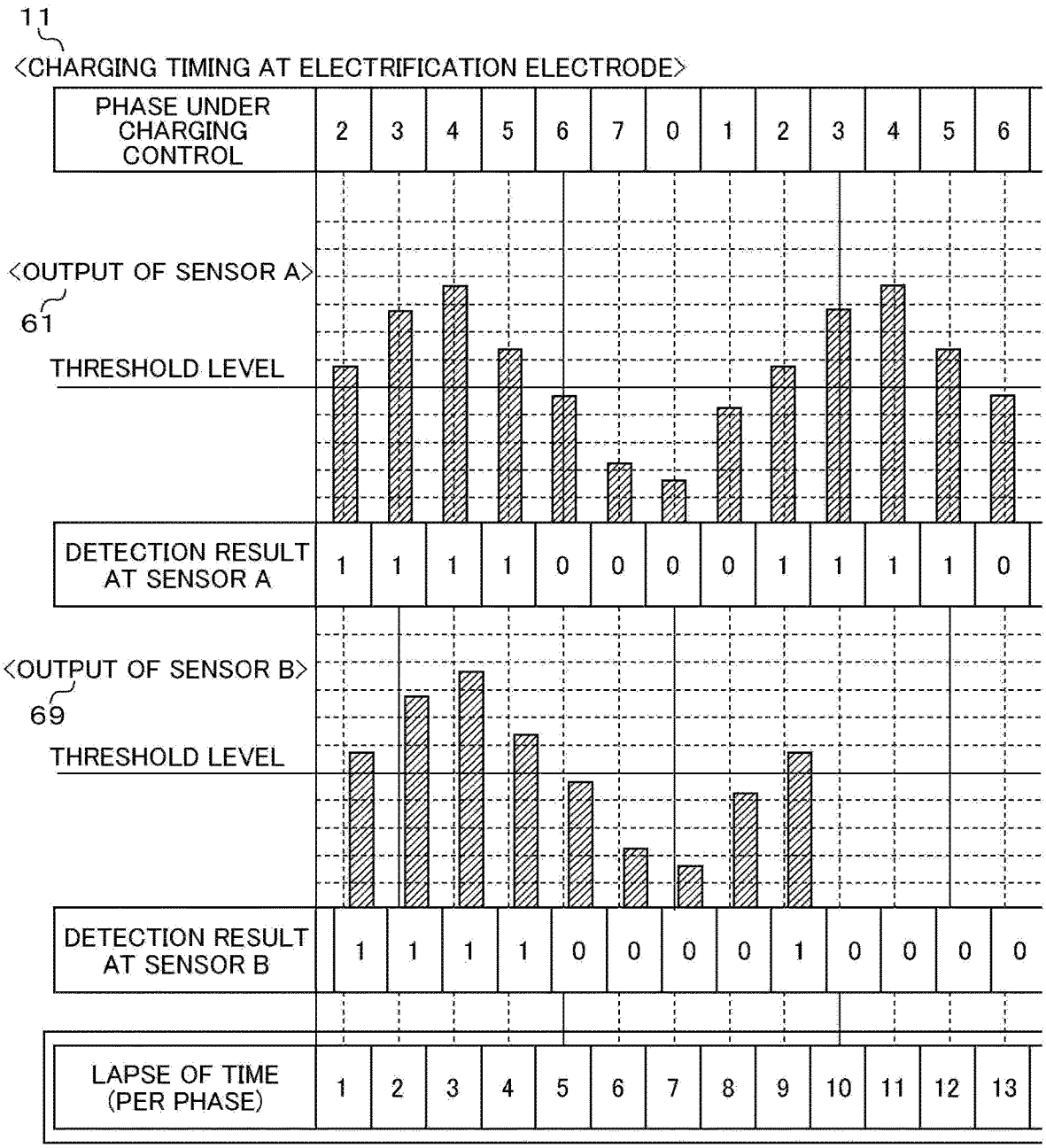
FIG. 5 is a view illustrating the phase detection data at anomaly according to the first embodiment.
Figure 6:
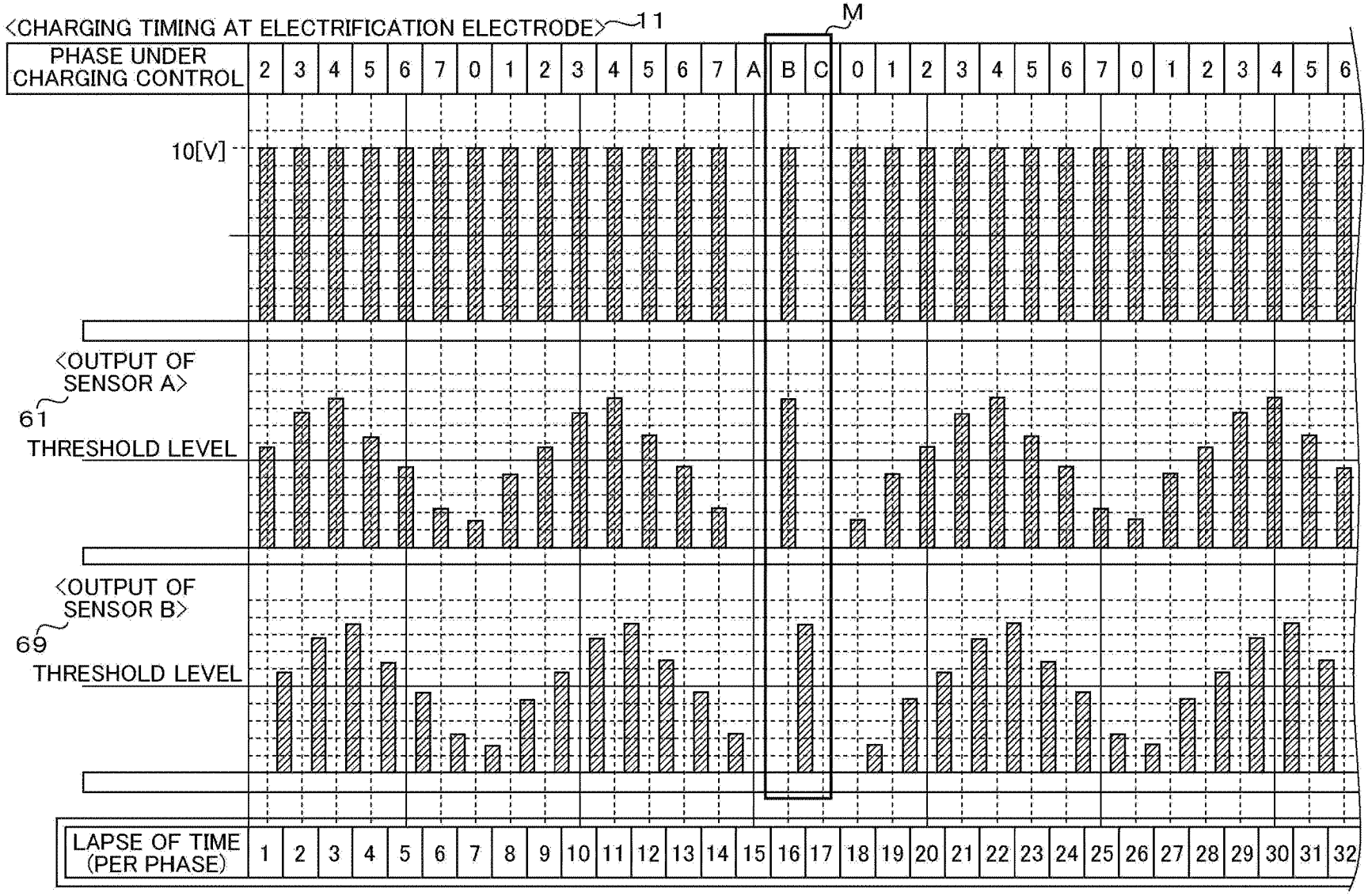
FIG. 6 is a view illustrating the phase detection data when the ink changed into particles is normal and the detection data at the time of measuring the flying speed of the ink particles according to the first embodiment.
Figure 7:
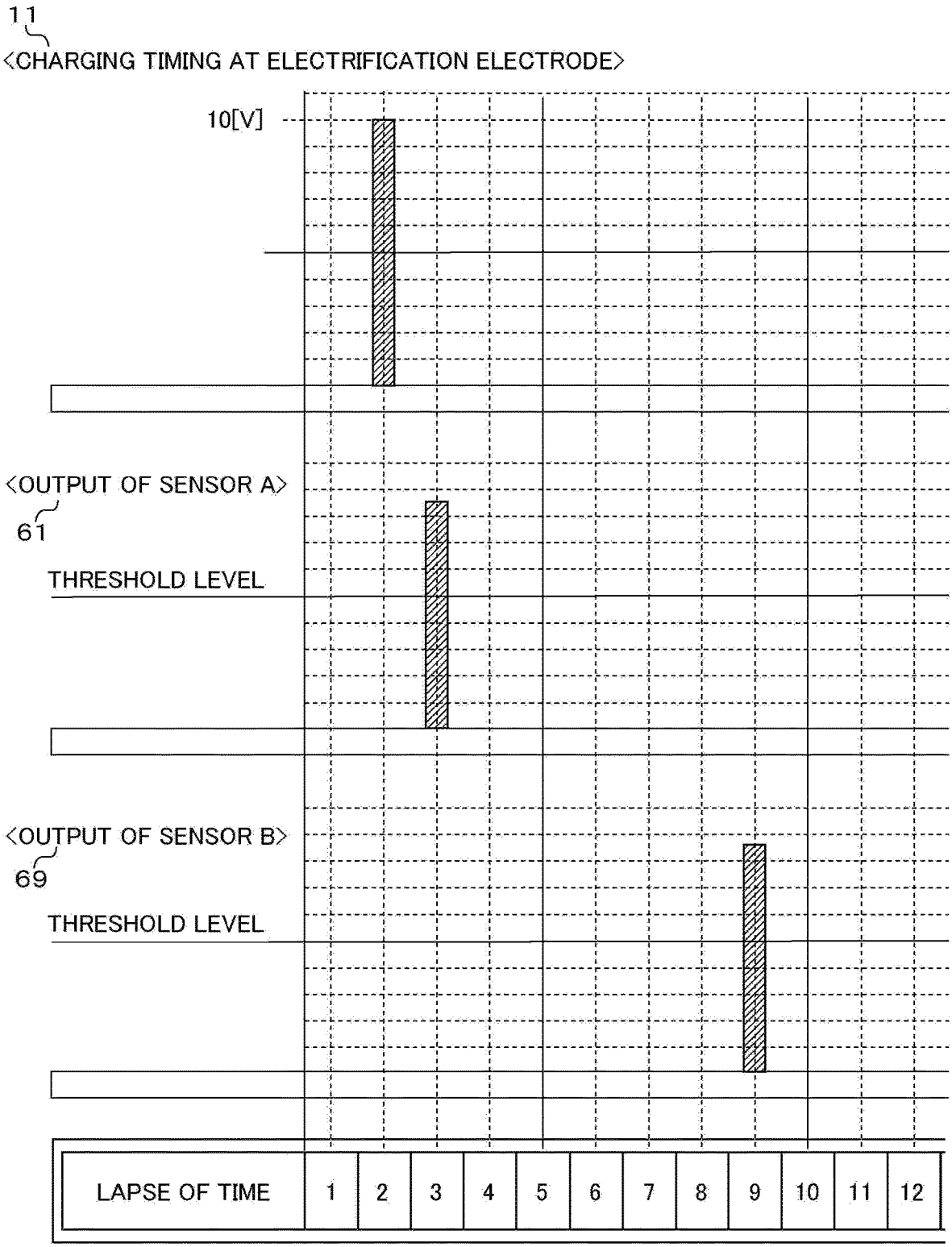
FIG. 7 is a view illustrating the detection data at the time of measuring the flying speed of the ink particles according to the first embodiment.

Now, explanation is given on the detection results of the first electric charge detection section (phase sensor A) 61 and the second electric charge detection section (phase sensor B) 69 of the inkjet recording apparatus 400 according to the present example with reference to FIGS. 4 to 7. FIG. 4 illustrate samples of the phase detection data when the ink changed into particles is normal and poor; FIG. 5 illustrates the detection result in the operation condition where anomaly occurs; FIG. 6 is a view illustrating the phase detection data when the ink changed into particles is normal and the detection data at the time of measuring the flying speed of the ink particles; and FIG. 7 illustrates the detection data at the time of measuring the flying speed of the ink particles with the scale of lapse of time at the M section of FIG. 6 enlarged.

In FIG. 4, what goes beyond the threshold level is defined as '1' while what does not go beyond it is defined as '0', in which according to the illustration of FIG. 4(*a*), four phases (to note, it can be said that the ink changed into particles is normal when there are three to five phases) are detected as those going beyond the threshold level (defined result: 1). If such normal condition corresponds to the detection result of the first electric charge detection section (phase sensor A) 61, it can be said that the ink particles 7C are in good shape and charging from the electrification electrode 11 is normal. In turn, if such normal condition corresponds to the detection result of the second electric charge detection section (phase sensor B) 69, it can be seen that the ink particles 7C are normally caught by the gutter 14.

It is illustrated in FIG. 4(*b*) that there is only one phase that goes beyond the threshold level (defined result: 1), in which the detected values result in being lower as a whole. If such condition corresponds to the detection result of the first electric charge detection section (phase sensor A) 61, the shape of the ink particles 7C is deteriorated or it can be said that the electric charge from the electrification electrode 11 does not proceed in a normal manner. In turn, if such condition corresponds to the detection result of the second electric charge detection section (phase sensor B) 69, it can be seen that the ink particles 7C are caught by the gutter 14 in a normal manner just because of the presence of the sensor output. In addition, by collating the detection result of the first electric charge detection section (phase sensor A) 61 with that of the second electric charge detection section (phase sensor B) 69, it permits the state of the ink changed into particles 7C and the charging timing at the electrification electrode 11 to be grasped in an more accurate manner.

It is illustrated in FIG. 4(*c*) that there is no phase that goes beyond the threshold level (defined result: 1), which means that it is in the condition where the minute electrification charge 58 cannot be detected. If such condition corresponds to the detection result of the first electric charge detection section (phase sensor A) 61, it is supposed that such a state possibly occurs as the ink particles 7C not passing over the first electric charge detection section (phase sensor A) 61 (e.g. no ink particle being jetted from the nozzle 8). In turn, such condition corresponds to the detection result of the second electric charge detection section (phase sensor B) 69, it can be seen that the ink particles 7C are not caught by the gutter 14.

Then, an example on the detection result of the operation condition when anomaly occurs is explained with reference to FIG. 5. In FIG. 5, on the charging timing of the electrification electrode 11; the detection result of the first electric charge detection section (phase sensor A) 61; and the detection result of the second electric charge section (phase sensor B) 69, the detection results in terms of the lapse of time (per time of measurement at each phase) are illustrated in a corresponding manner. For instance, when the lapse of time is at '2', the phase of the electrification electrode 11 under charging control corresponds to '3'; the detection result (defined result) at the sensor A of the first electric charge detection section (phase sensor A) 61 corresponds to '1'; and the detection result (defined result) at the sensor B of the second electric field detection section (phase sensor B) 69 also correspond to '1'. In short, it is illustrated that up to the lapses of time from '1' to '9', the defined results of the first electric charge detection section (phase sensor A) 61 and those of the second electric charge detection section (phase sensor B) 69 are identical to one another, in which it can be said through cross-checking between those two sensors, the reliability of the phase search results is enhanced.

In turn, at the lapses of time '10' to '12', on the one hand, the detection result (defined result) at the sensor A of the first electric charge detection section (phase sensor A) 61 is defined as '1', on the other hand, the detection result (defined result) at the sensor B of the second electric charge detection section (phase sensor B) 69 is defined as '0', so that there is difference in detection result. In this case, since the first electric charge detection section (phase sensor A) 61 has the same normal detection result as the lapses of time from '1' to '9', it can be seen that there is no problem with the ink changed into particles. In other words, this condition indicates that the ink changed into particles is normal, but there is high likelihood that the ink particles 7C might not be caught by the gutter 14. Based on such detection results, it is arranged such that the MPU 320 instructs the display device 325 to indicate such anomaly on the screen to advise an operator of the same.

Now, the method of measuring the flying speed of ink particles is explained with reference to FIGS. 6 and 7. In FIG. 6, on the charging timing of the electrification electrode 11; the detection result of the first electric charge detection section (phase sensor A) 61; and the detection result of the second electric charge detection section (phase sensor B) 69, the detection results in terms of the lapse of time (per phase) are illustrated in a corresponding manner. Here, at the lapses of time from '1' to '14' and '18' to '32', the electrification electrode 11, in order to grasp the charging timing there, applies the voltage of 10V at eight phases from '0' to '7' in total illustrated in 'phase under charging control' with the application timing displaced among such phases to apply electric charge for phase search to the ink particles 7C. Then, according to the timing when such voltage is applied by the electrification electrode 11, it is arranged such that different electric charge is electrified to the ink particles 7C, in which as to how large electric charge is applied to the ink particles 7C in the end, it can be detected by the first electric charge detection section (phase sensor A) 61 and the second electric charge detection section (phase sensor B) 69. Consequently, the result detected by the first electric charge detection section (phase sensor A) 61 and the result detected by the second electric charge detection section (phase sensor B) 69 are illustrated as 'output of sensor A' and 'output of sensor B' respectively.

According to the illustration of FIG. 6, it can be said that the detected value of the first electric charge detection section (phase sensor A) 61 and that of the second electric charge detection section (phase sensor B) 69 are largest when such voltage is applied at the timing corresponding to the phase '4' under charging control, so that such timing is optimal for electrically charging the ink particles by the electrification electrode 11.

Further, according to the present example, it allows the flying speed of the ink particles 7C to be measured as well, in which such measurement is carried out at the lapses of time (per phase) '15', '16' and '17' and the corresponding phases under charging control are defined as 'A', 'B' and 'C'. It is arranged such that at the timing corresponding to the lapse of time (per phase) '15', the application of the voltage 10V at the electrification electrode 11 is halted once, and at the timing corresponding to the lapse of time (per phase) '16' or the timing optimal for applying the voltage to the ink particles 7C (e.g. at the phase '4'), such voltage is applied to such particles by the electrification electrode 11. Then, at the timing corresponding to the lapse of time (per phase) '17', the application of such voltage at the electrification electrode 11 is halted. In this way, by halting the application of such voltage to the ink particles 7C by the electrification electrode 11 at the lapses of time (per phase) '15' and '17', the ink particles C electrically charged at the lapse of time (per phase) '16' can enhance the precision with which the time to be detected by the first electric charge detection section (phase sensor A) 61 and the second electric charge detection section (phase sensor B) 69 respectively is measured.

Then, FIG. 7 illustrates the M section squarely surrounding the lapses of time (per phase) '15' to '17' according to the illustration of FIG. 6 with the scale of such lapses of time enlarged, in which on the charging timing of the electrification electrode 11; the detection result of the first electric charge detection section (phase sensor A) 61; and the detection result of the second electric charge detection section (phase sensor B) 69, the detection results in terms of the lapse of time are illustrated in a corresponding manner. With reference to FIG. 7, for example, at the timing corresponding to the lapse of time '2', the electrification electrode 11 applies the voltage 10V which is so small for ink particles 7D unused for printing as not to pop out of the gutter 14 through the deflection field prepared by the deflection electrodes 12 to such particles. Then, it is illustrated in the drawing that the first electric field detection section (phase sensor A) 61 detects the pass-through of the ink particles 7D electrified with minute electric charge at the timing corresponding to the lapse of time '3'; and the second electric charge detection section (phase sensor B) 69 detects that the ink particles 7D electrified with minute electric charge have dropped in the gutter 14 at the timing corresponding to the lapse of time '9'.

Then, the lapses of time from the ink particles 7D being charged at the electrification electrode 11 up to the electric charge being detected by the first electric charge detection section (phase sensor A) 61 and by the second electric charge detection section (phase sensor B) 69 are compared on a trial basis. To this end, for instance, comparing the timing when the electric charge is detected by the first electric charge detection section (phase sensor A) 61 with the timing when the electric charge is detected by the second electric detection section (phase sensor B) 69, since the timing when the voltage 10V is applied to the ink particles 7D by the electrification electrode 11 corresponds to the lapse of time '2' and the timing when the electric charge is detected by the first electric charge detection section (phase sensor A) 61 corresponds to the lapse of time '3', the electric charge is detectable by the first electric charge detection section (phase sensor A) 61 at the lapse of time '1' ('3' minus '2'). On the other hand, since the timing when the electric charge is detected by the second electric charge detection section (phase sensor B) 69 corresponds to the lapse of time '9', the electric charge is detectable by the phase sensor B69 at the lapse of time '7' ('9' minus '2') after the ink particles 7D are charged by the electrification electrode 11.

In other words, by determining the charging timing of the electrification electrode 11 based on the detection result of the first electric charge detection section (phase sensor A) 61, it allows the phase search time for determining the charging timing to be shortened by about one-sevenths in comparison with the case where such charging timing is determined based on the detection result of the second electric charge detection section (phase sensor B) 69. More specifically, because the duration from the time when the electrification signal for phase search is outputted by the electrification electrode 11 to the time when the phase determination by the first electric filed detection section (phase sensor A) 61 is made can be largely shortened, which leads to enabling the printing interval to be shortened under the practical use such as high-speed printing for the benefit of the users. Further, e.g. in the case of the temperature change in which the transition from the ink column 7B to the ink particles 7D is prone to proceeding faster, by using the first electric charge detection section (phase sensor A) 61, it allows the optimal charging timing to be detected at the early stage, which leads to securing more stable printing quality.

Further, by checking difference between the time when the electric charge is detected by the first electric charge detection section (phase sensor A) 61 and the time when the electric charge is detected by the second electric charge detection section (phase sensor B) 69, it permits the flying speed of the ink particles 7D to be calculated. As to the shape of the ink particles optimal for printing, it can be estimated to some extent from the flying speed of the ink particles 7D, so that it may be arranged such that the flying speed of the ink particles 7C is fed back to the MPU 320, thereby implementing, the ink pressure control by means of the pressure regulating valve 33, the ink viscosity control by means of the viscosity meter 43, the heating control by means of the heater 44 and the excitation voltage control by means of the excitation voltage generation circuit 341.

Figure 8:
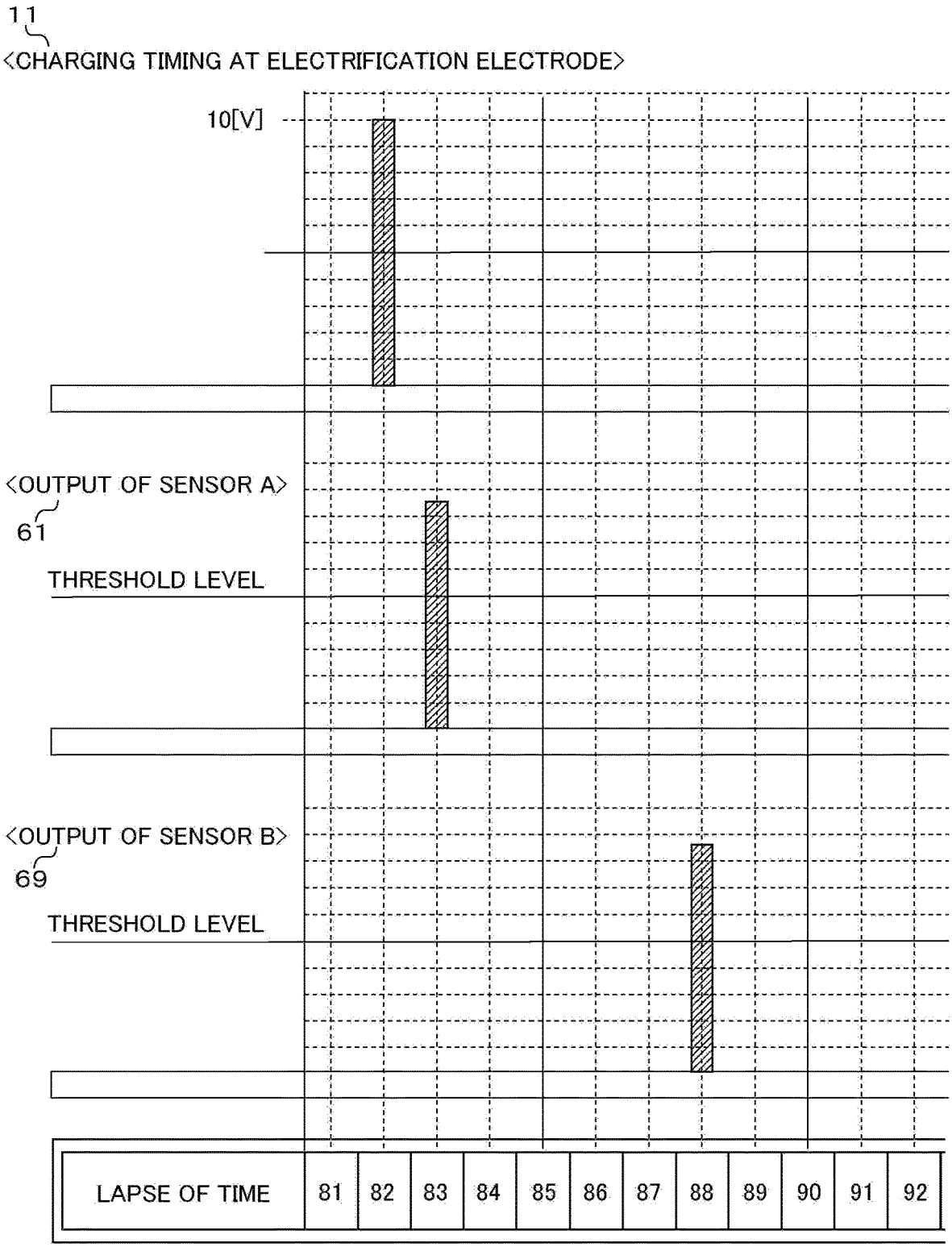
FIG. 8 is a view illustrating the detection data at the time of measuring the flying speed of the ink particles after the pressure applied to the ink is adjusted according to the first embodiment.

FIG. 8 illustrates the detection result after the pressure applied to the ink being supplied to the nozzle 8 is adjusted by regulating the pressure regulating valve 33 based on the calculation results of the flying speed of the ink particle 7D through the first electric charge detection section (phase sensor A) 61 and the second electric charge detection section (phase sensor B) 69. According to the illustration of FIG. 8, since the timing when the voltage 10V is applied to the ink particles 7D by the electrification electrode 11 corresponds to the lapse of time '82'; the timing when the electric charge is detected by the first electric charge detection section (phase sensor A) 61 corresponds to the lapse of time '83'; and the timing when the electric charge is detected by the second electric charge detection section (phase sensor B) 69 corresponds to the lapse of time '88', it can be seen that as to the second electric charge detection section (phase sensor B) 69, the electric charge is detectable at the lapse of time '6' ('88' minus '82') after the ink particles 7D are charged by the electrification electrode 11. In this way, based on the detection result of the first electric charge detection section (phase sensor A) 61 and the second electric charge detection section (phase sensor B) 69 respectively, it can adjust the pressure applied to the ink (the pressure applied to the ink to be controlled) under such conditions as leading to a higher quality of the printing.

With the inkjet recording apparatus 400 according to the present example, on the change in pressure applied to the ink in a short time (e.g. the pressure applied to the ink reducing owing to the malfunction of the pump (for feed) 24), it can be detected by means of the phase search signal explained with reference to the illustration of FIG. 5 or by means of the pressure sensor 31.

Thus, on the adjustment of the pressure applied to the ink under control by detecting the flying speed of the ink particles 7D mentioned above, it just can cope with the change in pressure applied to the ink on a long-time basis (e.g. fluctuation in pressure applied to the ink caused by the ink viscosity changing along with the ambient temperature changing). Such detection of the flying speed of the ink particles 7D is implemented between the printings on objects to be printed, e.g. during the interval between the printing completed on an object to be printed at hand and the printing started on the next object to be printed.

Figure 9:
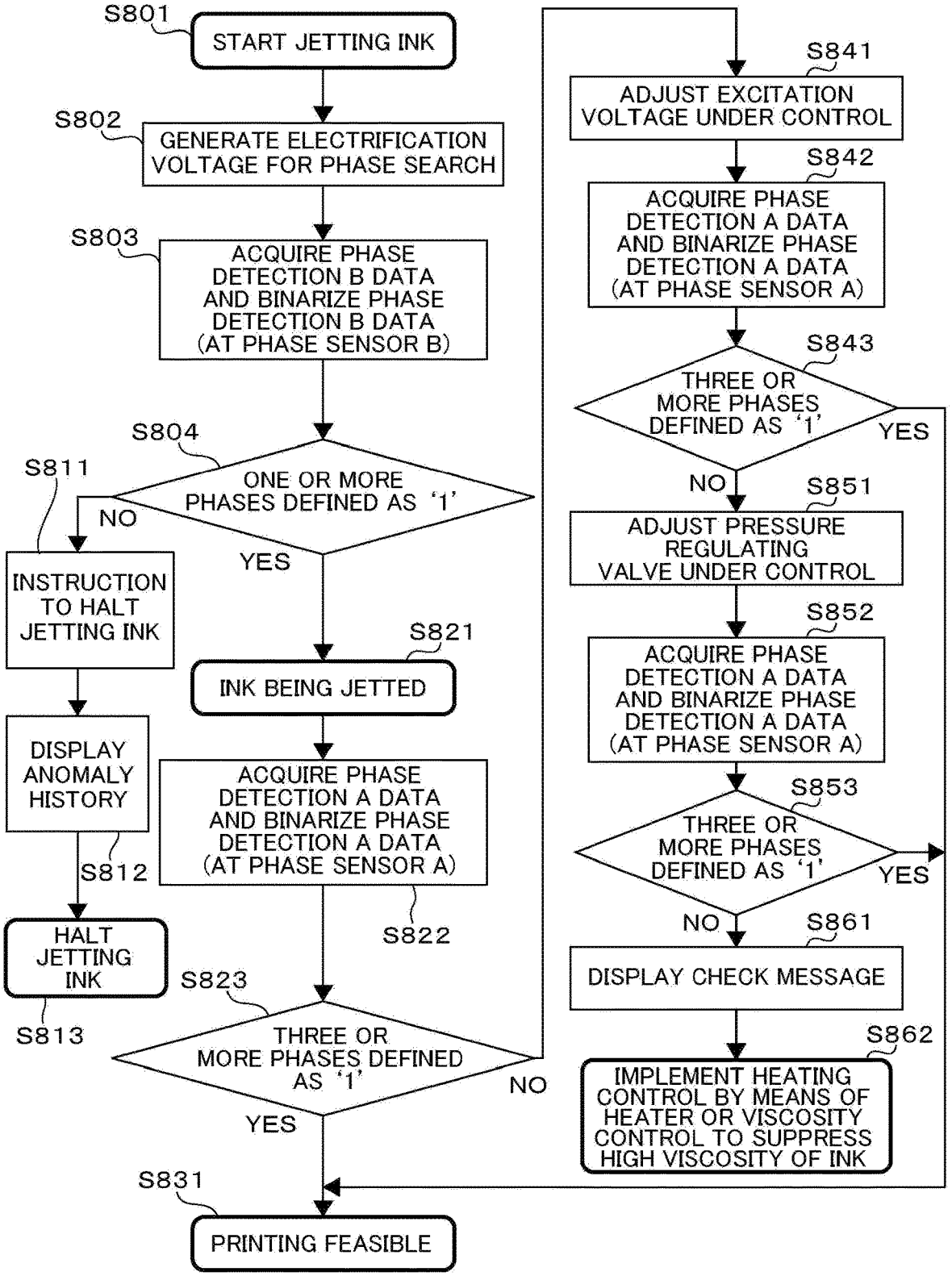
FIG. 9 is a flow chart for detecting the state where the ink changes into particles and for controlling the optimization of changing the ink into particles according to the first embodiment.

Then, the control operations of the MPU 320 related to the phase search, determination on electrification anomaly, and the optimal method of controlling the ink changed into particles in view of the inkjet recording apparatus 400 according to the present example are explained with reference to FIG. 9. FIG. 9 is a control flow chart illustrating the phase search for the timing of changing the ink into particles and covering the state where changing the ink into particles is unstable up to its countermeasures taken.

With reference to FIG. 9, in the first place or at Step S801, it indicates the state where the ink 7C changed into particles start being jetted from the nozzle 8 by a user manipulating the input panel 324 so as to instruct the apparatus to start operating.

At Step S802, an instruction is given to the phase search signal generation circuit 351 to generate a voltage for phase search to trigger the phase search.

At Step S803, the phase detection data in which the detection signal outputted from the second electric charge detection section (phase sensor B) 69 is converted into the digitalized signal mode when the voltage for phase search is being generated are acquired from the A/D converter B372; and the phase detection data acquired from the A/D converter B372 are binarized compared with the prescribed value (threshold level). It may be arranged such that such binarized data is inputted from the phase determination circuit B371. Hereupon, what goes beyond the threshold level is defined as '1' while what does not go beyond the same is defined as '0'.

At Step S804, the number of the phase detection data defined as '1' in one cycle (eight phases) among those binarized at Step S803 is counted and whether or not those defined as '1' correspond to one or more phases is checked. If in the affirmative or there is one or more phases corresponding to those defined as '1', it is judged as 'YES' (ink particles 7C being in the gutter 14) and the control operations proceed to the Step S821. If there is no phase corresponding to those defined as '1', it is judged as 'NO' (the ink particles 7C being not in the gutter 14) and the control operations proceed to the Step S811.

At Step S811, since it is judged that there is no ink particle 7C in the gutter 14, in order to alleviate the ink smudge around the apparatus, an instruction is given to halt the jetting of the ink from the nozzle 8.

At Step S812, anomaly occurrence is indicated on the display device 325, thereby, advising a user of such event. Then, at Step S813, the jetting of the ink from the nozzle 8 is in the state of being halted. The inkjet recording apparatus 400 maintains such state until such anomaly is reinstated by an operator and the subsequent instruction is given.

At Step S821, it indicates the state where the ink 7C changed into particles are jetted from the nozzle 8; and the ink particles 7C are recovered from the gutter 14.

At Step 822, the phase detection data in which the detection signal outputted from the first electric charge detection section (phase sensor A) 61 is converted into the digitalized signal mode when the voltage for phase search is being generated are acquired from the A/D converter A362; and the phase detection data acquired from the A/D converter A362 are binarized compared with the prescribed value (threshold level). It may be arranged such that such binarized data are inputted from the phase determination circuit A361. Hereupon, what goes beyond the threshold level is defined as '1' while what does not go beyond the same is defined as '0'.

At Step S823, the number of the phase detection data defined as '1' in one cycle (eight phases) among those binarized at the Step S823 is counted; and whether or not those defined as '1' correspond to three or more phases is checked. If in the affirmative or there are three or more phases corresponding to those defined as '1', it is judged as 'YES' (the shape of the ink particles is favorable, so that the state of the ink particles 7C electrically charged is favorable likewise) and the control operations proceed to the Step S831. If there are two or less phases corresponding to those defined as '1', it is judged as 'NO' (the shape of the ink particles is unfavorable, so that the state of the ink particles 7C electrically charged is unfavorable likewise) and the control operations proceed to the Step S841.

At Step S831, it indicates the state where the printing is feasible on the ground that it is judged that as to the ink particles 7C, the normal course of changing the ink into particles is taken and the normal phase search is conducted. Thereafter, the control operations return to the Step S821 in which the change in electrification timing is monitored on a long-time basis by repeating the steps from S821 to S831.

Then, at Step 841, an instruction is given to the excitation voltage generation circuit 341 to adjust excitation voltage which gives an influence on the shape of the ink particles 7C such that the optimal shape of such particles is achieved.

At Step S842, the phase detection data in which the detection signal outputted from the first electric charge detection section (phase sensor A) 61 is converted into the digitalized signal mode when the voltage for phase search is being generated are acquired from the A/D converter A362; and the phase detection data acquired from the A/D converter A362 are binarized compared with the prescribed value (threshold level). It may be arranged such that such binarized data are inputted from the phase determination circuit A361. Hereupon, what goes beyond the threshold level is defined as '1' while what does not go beyond the same is defined as '0'.

At Step S843, the number of the phase detection data defined as '1' in one cycle (eight phases) among those binarized at Step S842 is counted; and whether or not there are three or more phases corresponding to those defined as '1' is checked. If in the affirmative or there are three or more phases corresponding to those defined as '1', it is judged as 'YES' (the shape of the ink particles is favorable, so that the state of the ink particles 7C electrically charged is favorable likewise) and the control operations proceed to the Step S831. If there are two or less phases corresponding to those defined as '1', it is judged as 'NO' (the shape of the ink particles is unfavorable, so that the state of the ink particles 7C electrically charged is unfavorable likewise) and the control operations proceed to the Step S851.

Then, at Step S851, pressure applied to ink which is required for changing the ink into particles is estimated at the MPU 320 based on information from the pressure detection circuit 334 connected to the pressure sensor 31;

and an instruction to that effect is given to the pressure adjustment control circuit 333. The MPU 320 may take into account such data as the measurement result of the viscosity meter 43, the detailed control of the heater 44, the measurement result of the temperature sensor 50A (not shown in the drawings) for measuring printing ambient and difference in minute electric charge detection timing between the first electric charge detection section (phase sensor A) 61 and the second electric charge detection section (phase sensor B) 69 in addition to information outputted from the pressure sensor 31.

At Step S852, the phase detection data in which the detection signal outputted from the first electric charge detection section (phase sensor A) 61 is converted into the digitalized signal mode when the voltage for phase search is being generated are acquired from the A/D converter A362; and the phase detection data acquired from the A/D converter A362 are binarized compared with the prescribed value (threshold level). It may be arranged such that such binarized data are inputted from the phase determination circuit A361. Hereupon, what goes beyond the threshold level is defined as '1' while what does not go beyond the same is defined as '0'.

At Step S853, the number of the phase detection data defined as '1' in one cycle (eight phases) among those binarized at Step S852 is counted; and whether or not there are three or more phases corresponding to those defined as '1' is checked. If in the affirmative or there are three or more phases corresponding to those defined as '1', it is judged as 'YES' (the shape of the ink particles is favorable, so that the state of the ink particles 7C electrically charged is favorable likewise) and the control operations proceed to the Step S831. If there are two or less phases corresponding to those defined as '1', it is judged as 'NO' (the shape of the ink particles is unfavorable, so that the state of the ink particles 7C electrically charged is unfavorable likewise) and the control operations proceed to the Step S861.

At Step S861, since it is judged that as to the ink particle 7C, the normal course of changing the ink into particles is not taken and the normal phase search is not conducted, a check message (or alarm message) is displayed in order to advise an operator of the state where the printing is not feasible. However, at Step S861, because the jetting of the ink from the nozzle 8 is normally feasible, the state where the ink is jetted continues.

At Step S862, by giving a control instruction to the heater control circuit 335 or the viscosity measurement circuit 331 from the MPU 320, the heating control by means of the heater 44 or the viscosity control is implemented such that the normal course of changing the ink into particles is taken and the normal phase search is conducted. Then, after the lapse of a certain time, the control operations return to the Step S821 to take Step S822, thereby, whether or not as to the ink particles 7C, the normal course of changing the ink into particles is taken and the normal phase search is conducted is checked.

To note, according to the present example, such control flow as what goes beyond the threshold level being defined as '1' while what does not go beyond the same being defined as '0' is explained, but the control operations may be performed by defining what goes beyond the threshold level as '0' while by defining what does not go beyond the same as '1'.

As described above, according to the present example, providing the first electric charge detection section (phase sensor A) 61 between the electrification electrode 11 and deflection electrodes 12 can detect the timing when the ink particles 7C are electrically charged in a short time, which leads to allowing the ink particles 7C to be electrically charged at by far the faster and optimal timing. Further, disposing the second electric charge detection section (phase sensor B) 69 on the secondary side of the gutter 14 permits whether or not the ink particles 7C are caught by the gutter 14 to be detected. In other words, with the provision of those two phase sensors (first electric charge detection section (phase sensor A) 61 and second electric charge detection section (phase sensor B) 69), such an inkjet recording apparatus is provided as allowing implementing electrification control on the ink particles 7C at the earlier and optimal timing even when the ambient in which the apparatus is used changes; and allowing grasping the stable printing quality to be secured with the reliability of the phase search result enhanced and the state where the ink particles 7C are caught by the gutter 14.

Second Example

Figure 10A:
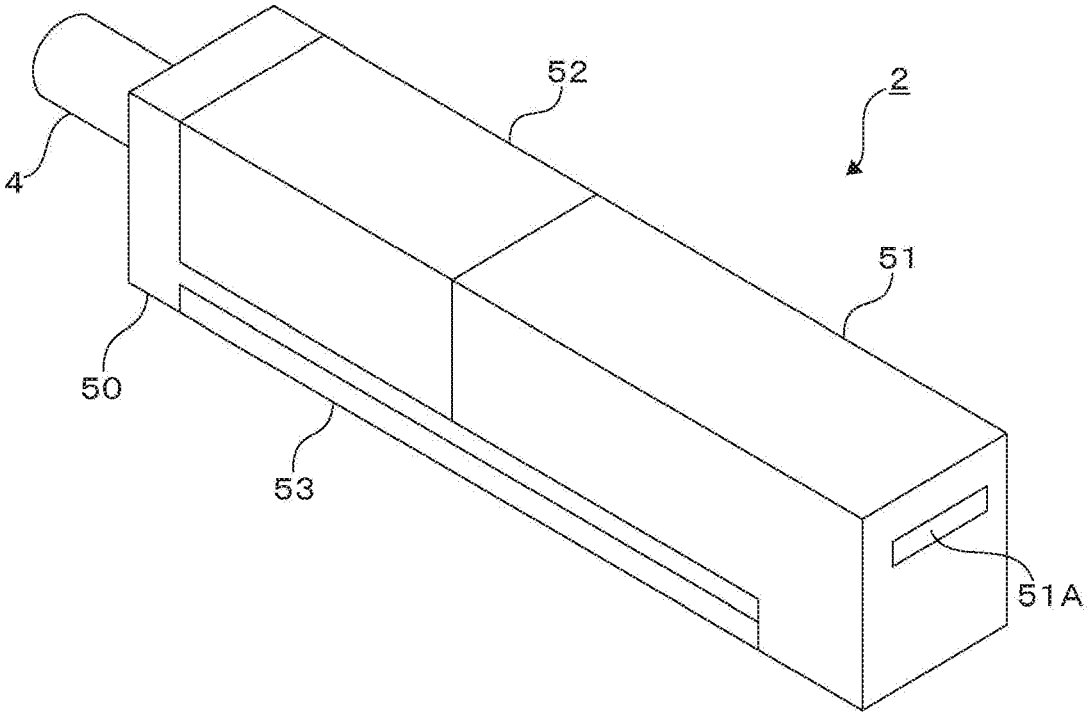
FIGS. 10A and 10B illustrate outer perspective views of the printing head according to a second embodiment.
Figure 10B:
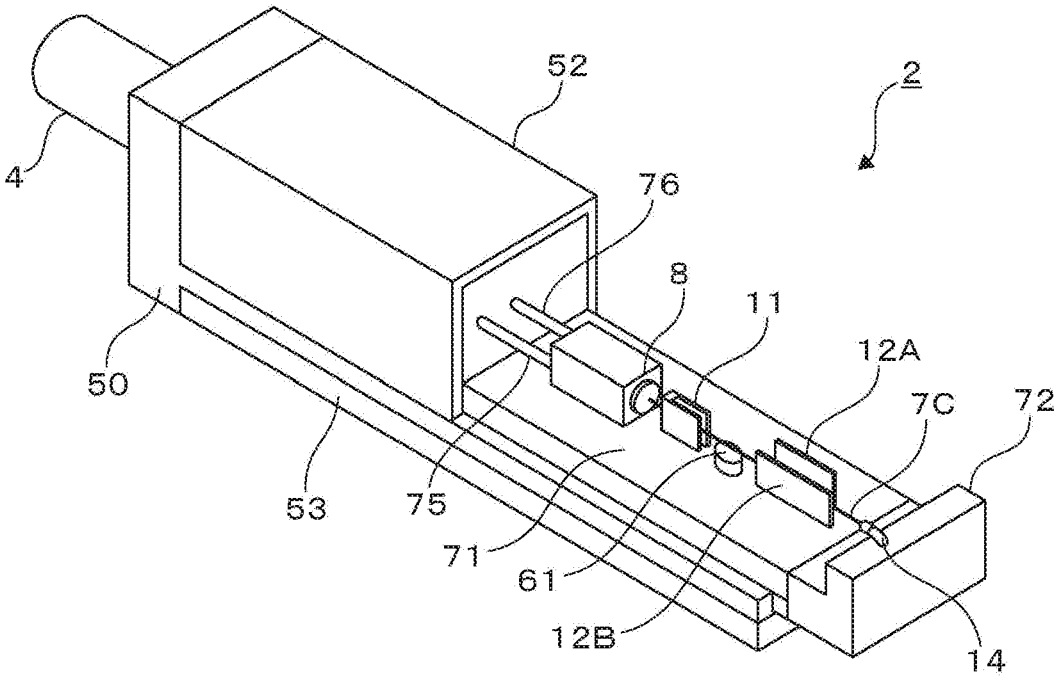

FIG. 10 illustrate outer perspective views of the printing head according to the second embodiment. FIG. 10(*a*) illustrates an outer perspective view of the printing head 2 while FIG. 10(*b*) illustrating a perspective view of the printing head 2 with its head cover 51 removed.

With reference to FIG. 10, the printing heads 2 includes a head base 50; a conduction pipe 4 interconnecting the main body 1 and the printing head 2; a head undercover 53 built in for the purpose of protecting components placed on the head base 50; a protection cover 52 built in for the purpose of protecting a heater 44 and a switch valve 42 disposed on the head base 50; a nozzle base 71; a gutter base 72; and the head cover 51 built in such that it covers the nozzle base 71 with a slit 51A through which the ink particles used for the printing pass formed therethrough. In the state where such head cover 51 is built in the printing head, the space enclosed by the nozzle base 71 and the head cover 51 is protected from e.g. impact applied upon maintenance. The components enclosed by such head cover 51 lie in the space where an operator working on a daily basis carries out maintenance jobs, in which the internal area enclosed by the head base 50 and the protection cover 52 as well as the internal area enclosed by the head base 50 and the head undercover 53 correspond to the areas where so-called service staff carry out maintenance jobs.

Then, a nozzle 8 to discharge an ink column 7B; an electrification electrode 11 disposed in parallel and symmetrically centering around the ink beam discharged from the nozzle 8; a first electric charge detection section (phase sensor A) 61 disposed to such a distance as not to make contact with the ink beam; and deflection electrodes 12 including a set of two sheets (a ground electrode 12B and a plus electrode 12A) disposed on the secondary side of the electrification electrode 11 in the flying direction of the ink beam are provided on the nozzle base 71. Further, the gutter base 72 is provided with a gutter 14 which is disposed on the secondary side of the deflection electrodes 12 in the flying direction of the ink beam and through which a hole is formed coaxially with the ink beam for catching the ink particles 7C unused for the printing. Moreover, a feeding tube 75 and a circulation tube 76 which are made from a solvent-proof PTFE material are connected to the nozzle 8.

Figure 11:
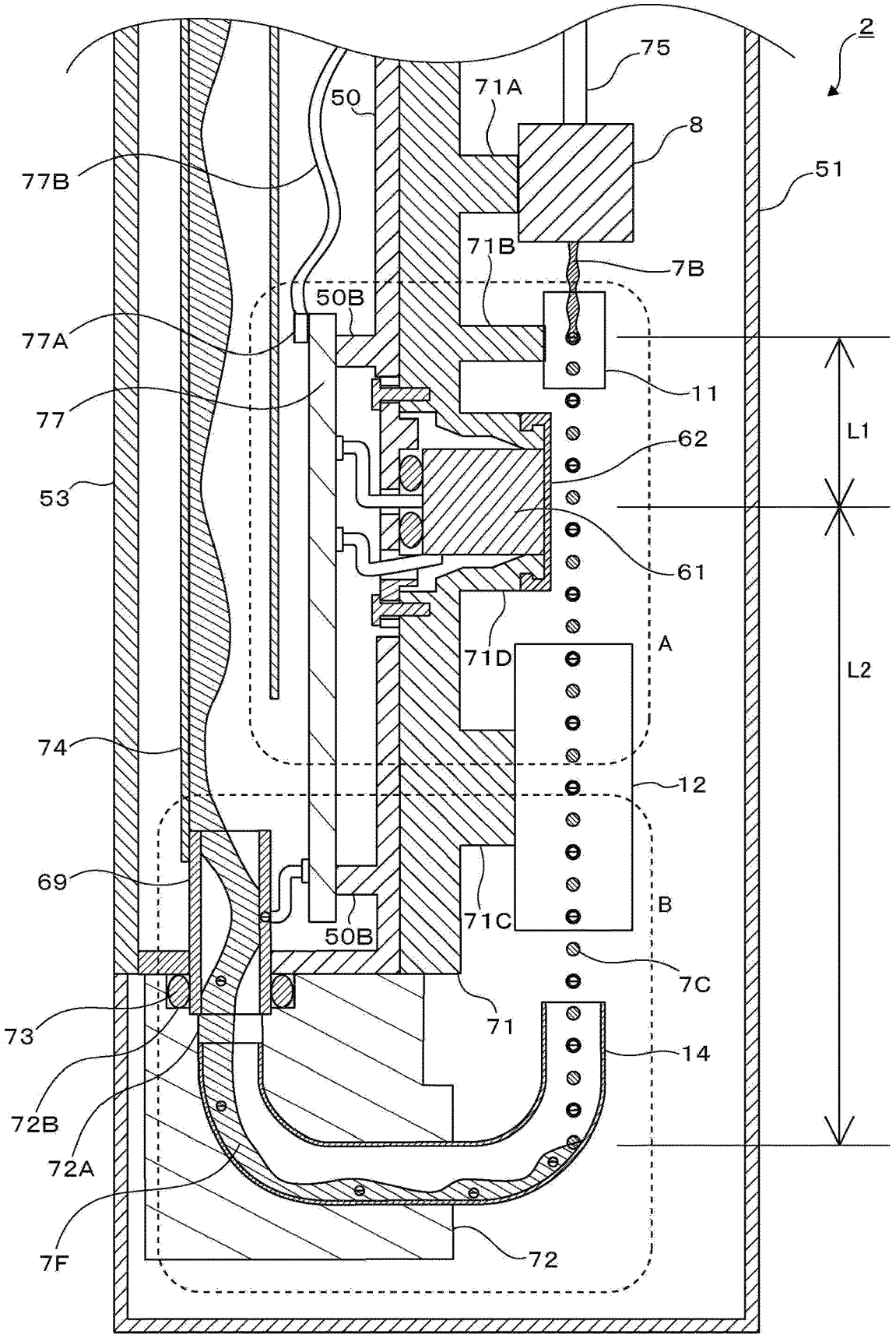
FIG. 11 is a view illustrating the structural arrangement of the printing head according to the second embodiment.
Figure 12:
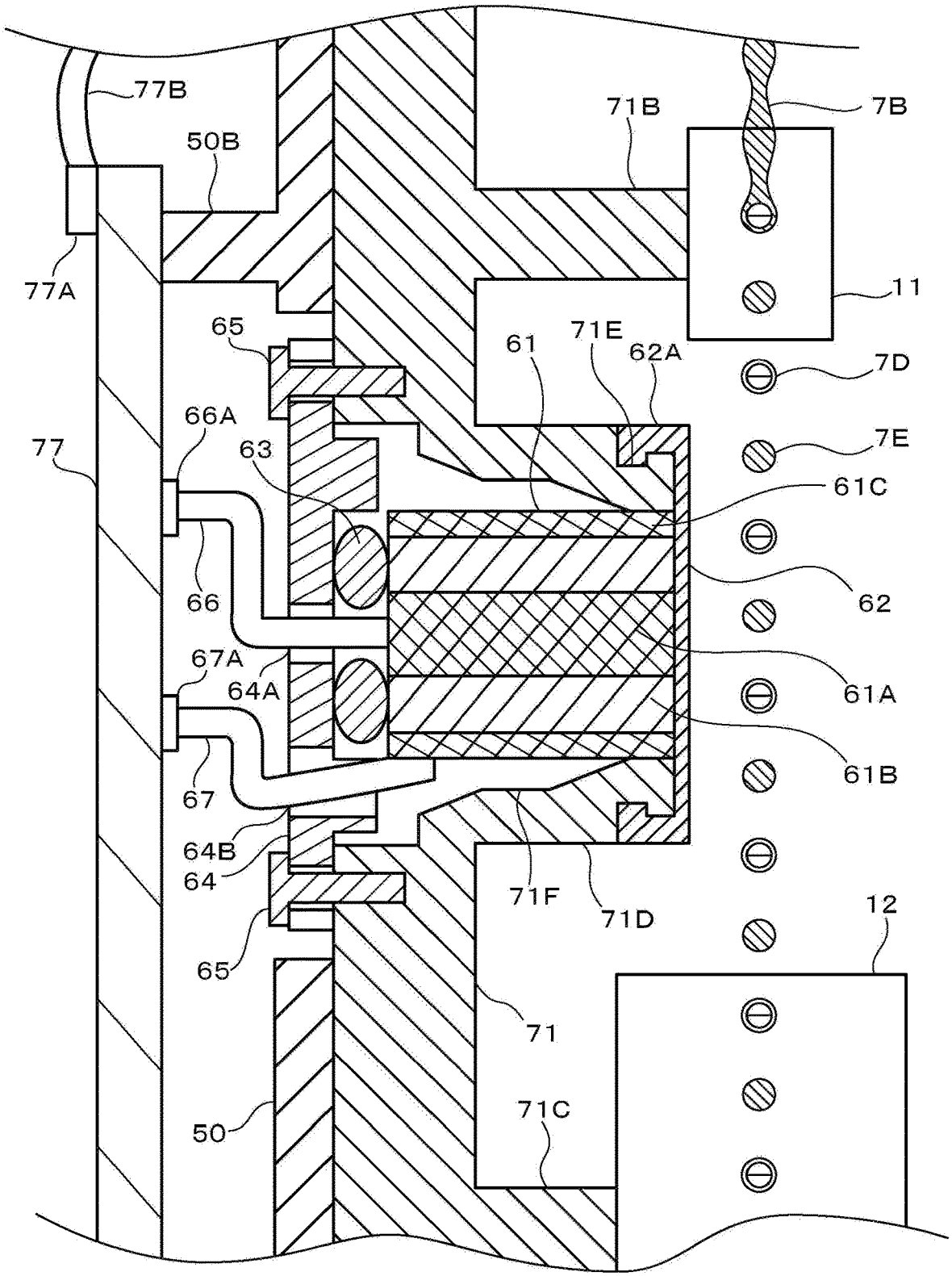
FIG. 12 is an enlarged view illustrating the structural arrangement of the sensor A section and its vicinity illustrated in FIG. 11.

Now, the detailed parts of the printing head according to the present example are explained with reference to FIGS. 11 to 13. FIG. 11 is a cross-sectional view illustrating the structure of the printing head 2 according to the present example; FIG. 12 illustrates an enlarged view of A section (around the first electric charge detection section (phase sensor A) 61) depicted in FIG. 11; and FIG. 13 illustrates an enlarged view of B section (around the second electric charge detection section (phase sensor B) 69) depicted in FIG. 11.

Figure 13:
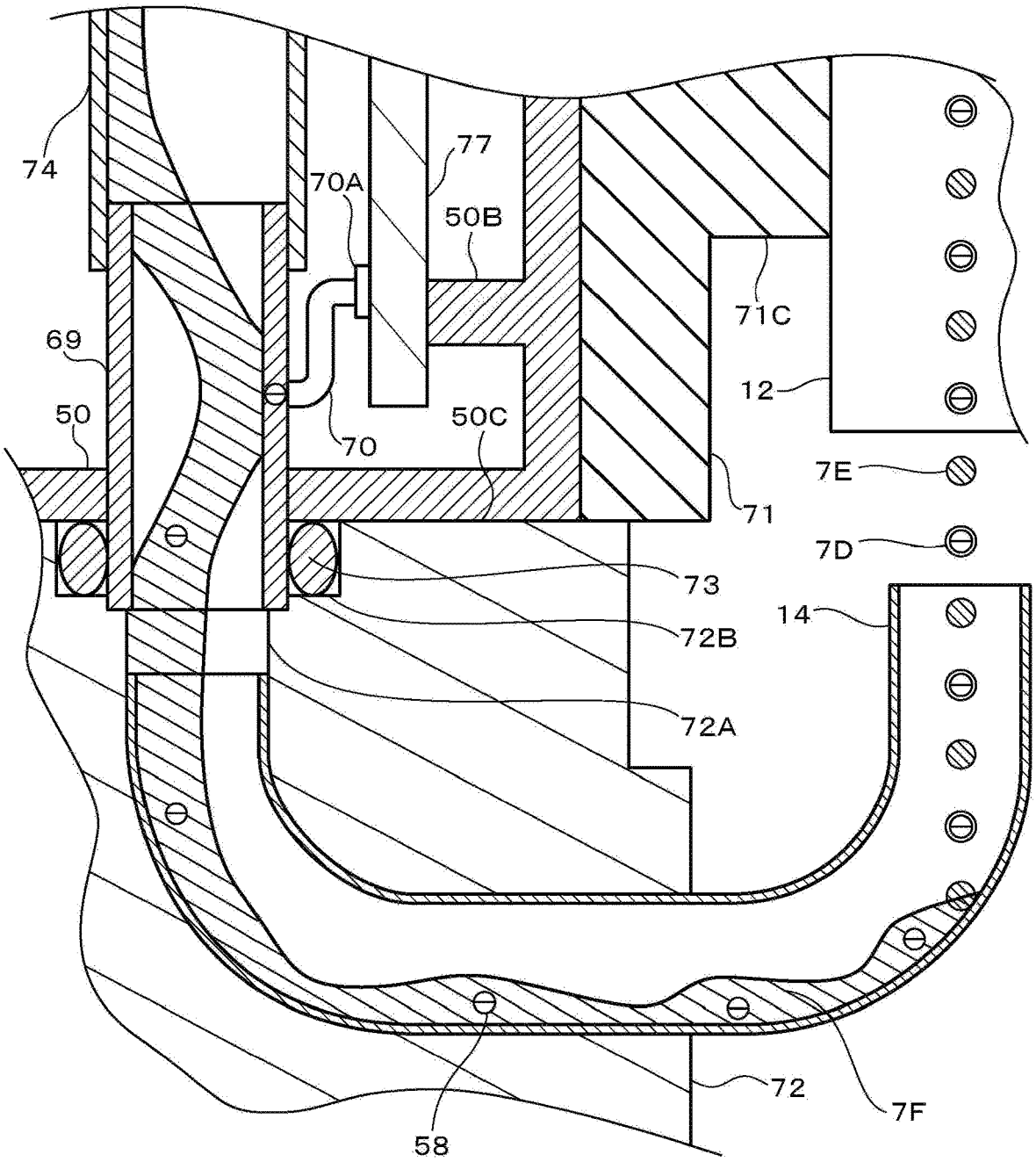
FIG. 13 is an enlarged view illustrating the structural arrangement of the sensor B section and its vicinity illustrated in FIG. 11.

With reference to FIGS. 11 to 13, the nozzle 8 is fixed through a nozzle fixing portion 71A formed on the nozzle base 71; the electrification electrode 11 is fixed through a fixing portion 71B formed on the nozzle base 71: and the deflection electrodes 12 are fixed through a fixing portion 71C formed on the nozzle base 71. The nozzle fixing portion 71A, the electrification electrode fixing portion 71B and the deflection electrodes fixing portion 71C which are formed on the nozzle base 71 respectively are stepped from the surface of the nozzle base 71 so that they have such a structure as creating creepage distance such that they are electrically insulated from the surface of the nozzle base.

Then, the nozzle base 71 is provided with a phase sensor A fixing portion 71D which is cylindrically formed and a phase sensor insertion hole portion 71F which is formed to make it hard to cause displacement when inserting and building in the phase sensor A. Further, as to the nozzle base 71, a cover 62 for the phase sensor A is built in the tip end of the phase sensor A fixing portion 71D, in which the fixing portion 71D and the cover 62 are fixed to each other by mating a side wall convex portion 62A formed on the cover 62 for the phase sensor A into a concave portion 71E formed on the fixing portion 71D. Hereupon, the nozzle base 71 is molded from e.g. polyphenylenesulfide (PPS) which is a solvent-proof resinous material; and the cover 62 for the phase sensor A is an insulator which is made from e.g. polypropylene (PP) and is formed by so-called insert injection molding in which a liquid-state resin is injected after the nozzle base 71 is inserted into a die. To note, since the sensitivity of the sensor is enhanced according as the phase sensor A comes closer to the flying path of the ink beam (ink particles 7C), it is preferred that the cover 62 for the phase sensor A be thin and made from a thinly filmed insulator.

Further, as to the nozzle base 71, an electrically conductive coat is applied to the surface opposed to that where the nozzle 8, the electrification electrode 11 and the deflection electrodes 12 are disposed and the surface of the phase sensor A insertion hole portion 71F respectively, thereby, allowing noises caused by the voltages generated from the deflection electrodes 12 and the electrification electrode 11 and influencing on the first electric charge detection section (phase sensor A) 61 to be abated.

The cylindrically shaped first electric charge detection section (phase sensor A) 61 is built into the phase sensor A insertion hole portion 71F of the nozzle base 71; and the first electric charge detection section (phase sensor A) 61 is fixed by a sensor A fixing member 64 built in the nozzle base 71 with such an elastic member 63 as sponges, rubbers and springs and fixing screws 65.

Now, the detailed arrangement of the first electric charge detection section (phase sensor A) 61 is explained. As to the first electric charge detection section (phase sensor A) 61, a center conducting wire 61A which outputs a signal when the ink particles 7D to which minute electric charge is applied pass through the same is formed at the center of its cylindrical shape; an insulating member 61B is formed in the outer circumference of the center conducting wire 61A; and an outer circumference electrically conductive member 61C for the purpose of removing noises is formed in its outer circumference. Further, the center conducting wire 61A of the first electric charge detection section (phase sensor A) 61 is electrically connected to a signal line A66 to transmit a signal corresponding to the electric charge detected at the center conducting wire 61A; and a connector B66A to connect the signal line to a phase sensor substrate 77 is built in the signal line 66. The phase sensor substrate 77 is built in the head base 50 through a substrate fixing portion 50B. Further, a GND line 67 which is connected to a GND potential such that the voltage is electrically maintained at 0V is built in the outer circumference conducting member 61C of the first electric charge detection section (phase sensor A) 61; and a connector C67A to connect the GND line to the phase sensor substrate 77 is built in the GND line 67.

Hereupon, because the first electric charge detection section (phase sensor A) 61 is disposed such that it is pushed on the cover 62 for the phase sensor A by the elastic member 63, it allows stabilizing the precision in the interval between the same and the ink particles 7D to which minute electric charge is applied. Further, the first electric charge detection section (phase sensor A) 61 secures the interval between the same and the ink particles 7D to which minute electric charge is applied or its positional precision with respect to the center axis of the ink beam through the shape of the phase sensor A fixing portion 71D, which permits the first electric charge detection section (phase sensor A) 61 to secure its positional precision with the ink particles 7D to which minute electric charge is applied and to conduct the stable phase search.

A hole A64A for an electric wire to make the signal line 66 pass through and a hole B64B for an electric wire to make the GND line 67 pass through are formed through the sensor A fixing member 64. Further, the connector B66A of the signal line 66 and the connector C67A of the GND line 67 are arranged such that they are removable and renewable, which leads to improving on the ease with which the first electric charge detection section (phase sensor A) 61 is assembled and exchanged. Furthermore, the phase sensor substrate 77 is connected through a connector A77A to a harness 77B in order to transmit the detection signals of the first electric charge detection section (phase sensor A) 61 and the second electric charge detection section (phase sensor B) 69 to the main body 1. The harness 77B is connected to the interior of the main body 1 via the inner side of the conduction pipe 4.

Then, the gutter 14 is formed with a pipe made from e.g. stainless steel (SUS) and is built in a gutter base 72 made from a resin (e.g. polybutylene terephtalate) through insert injection molding so as to be integrally formed into one piece. The gutter base 72 is built in a side wall portion 50C of the head base 50 and is internally formed with a gutter base interior channel 72A which is connected to the internal channel of the gutter 14. The gutter base interior channel 72A is connected to the second electric charge detection section (phase sensor B) 69 to detect the ink particles 7D to which minute electric charge is applied and which are caught by the gutter 14; and the second electric charge detection section (phase sensor B) 69 is sealed by an O ring 73 mounted into a gutter base groove 72B which is formed through the gutter base 72 lest that the ink 7F leaks outside from the connection portion with the gutter base 72.

The second electric charge detection section (phase sensor B) 69 is connected to a recovery tube 74; the ink particles 7C, 7D and 7E caught by the gutter 14 are placed into the state like ink 7F on the recovery path illustrated in the drawing upon dropping on the inner wall of the gutter 14 and flow in the direction of the second electric charge detection section (phase sensor B) 69 toward the main body 1 through the inner wall of the gutter under the suction force of a pump (for recovery) 25 so as to be recovered in the main ink receptacle 18 within the main body 1. It should be noted that the second electric charge detection section (phase sensor B) 69 is disposed farther downstream where the ink is recovered than the location where the ink particles drop with respect to the gutter 14, thereby, allowing the second electric charge detection section (phase sensor B) 69 to be advantageously disposed at a place comparatively wider in space.

Further, the second electric charge detection section (phase sensor B) 69 is made from a solvent-proof and electrically conductive material (e.g. stainless steel (SUS)) and is electrically connected to a signal line B70 to transmit a signal upon detecting minute electrification charge 58; and a detachably attachable connector D70A to connect the signal line to the phase sensor substrate 77 is built in the signal line 70.

The ink 7A used for the inkjet recording apparatus 400 is made from an electrically conductive material in terms of an ink composition substance. The ink 7F caught by the gutter 14 on the recovery path are in the electrically conductive state up to the second electric charge detection section (phase sensor B) 69 along the inner wall of the recovery path. Thus, at the same time as the ink particles 7D to which minute electric charge is applied dropping on the inner wall of the gutter 14, minute electrification charge 58 flows along with the ink 7F on the recovery path and is detected a signal after it arrives at the second electric charge detection section (phase sensor B) 69.

With the inkjet recording apparatus 400 according to the present example, it is arranged such that at the timing when the tip end of the ink column 7B jetted from the nozzle 8 is separated into the ink particles 7C, the electrically charged ink particles 7D with minute electrification charge 58 by the electrification electrode 11 and the non-charged ink particles 7E are alternatively prepared from the ink particles 7C unused for the printing, thereby, allowing the charging precision of minute electrification charge 58 by the electrification electrode 11 to be enhanced as well as noises likely to occur at the charging timing of the electrification electrode 11 and influencing on the first electric charge detection section (phase sensor A) 61 to be alleviated.

Further, according to the inkjet recording apparatus 400 embodied herein, it allows grasping the timing when the electric charge of the ink particles 7D subjected to minute electrification is detected at the first electric charge detection section (phase sensor A) 61 from the charging timing of the electrification electrode 11, which leads to enabling the flying speed of the ink particles 7C to be calculated based on the interval (L1 depicted in FIG. 11) from the electrification electrode 11 to the first electric charge detection section (phase sensor A) 61. Further, according to the inkjet recording apparatus 400 embodied herein, it allows detecting the timing when the ink particles 7D subjected to minute electrification have passed through the first electric charge detection section (phase sensor A) 61 and the timing when they have dropped on the inner wall of the gutter 14, which leads to enabling the flying speed of the ink particles 7C to be calculated based on the interval (L2 depicted in FIG. 11) from the first electric charge detection section (phase sensor A) 61 to the location within the inner wall of the gutter 14 where the ink particles 7C have dropped as well.

Since the flying speed of the ink particles 7C give an influence on the flying course of the ink particles which drop on the inner wall, making such adjustment as for the flying speed of the ink particles 7C to be defined under each and every condition further enhances the printing quality of the inkjet recording apparatus 400. Thus, the inkjet recording apparatus 400 implements adjustment control on pressure applied to the ink by means of the pressure regulating valve 33 or heating control by means of the heater 44 or control on the ink viscosity based on the flying speed of the ink particles 7C computed by the first electric charge detection section (phase sensor A) 61 and the second electric charge detection section (phase sensor B) 69 respectively.

In view of the foregoing, according to the present example, by enhancing the positional precision with which the first electric charge detection section (phase sensor A) 61 is attached, it allows improving the precision with which the first electric charge detection section (phase sensor A) 61 detects electric charge, which leads to providing an inkjet recording apparatus which can implement the phase search control based on the feed-back of more correct phase detection results.

Further, according to the present example, by using the first electric charge detection section (phase sensor A) 61 and the second electric charge detection section (phase sensor B) 69, it allows the flying speed of the ink particles 7C to be calculated, which leads to providing an inkjet recording apparatus which can flexibly respond to the change in use environment with the calculated flying speed result fed back to the printing control.

Further, according to the present example, by adopting the arrangement in which noises causing obstacles when the phase sensor 61 detects the electric charge of the ink particles 7D subjected to minute electric charge are alleviated and implementing the control to that effect, the inkjet recording apparatus 400 can implement more stable phase search control, which leads to providing an inkjet recording apparatus which enables the electric charge of the ink particles 7C used for the printing to be measured and the state of electrification charge to be monitored as well.

Third Example

Figure 14:
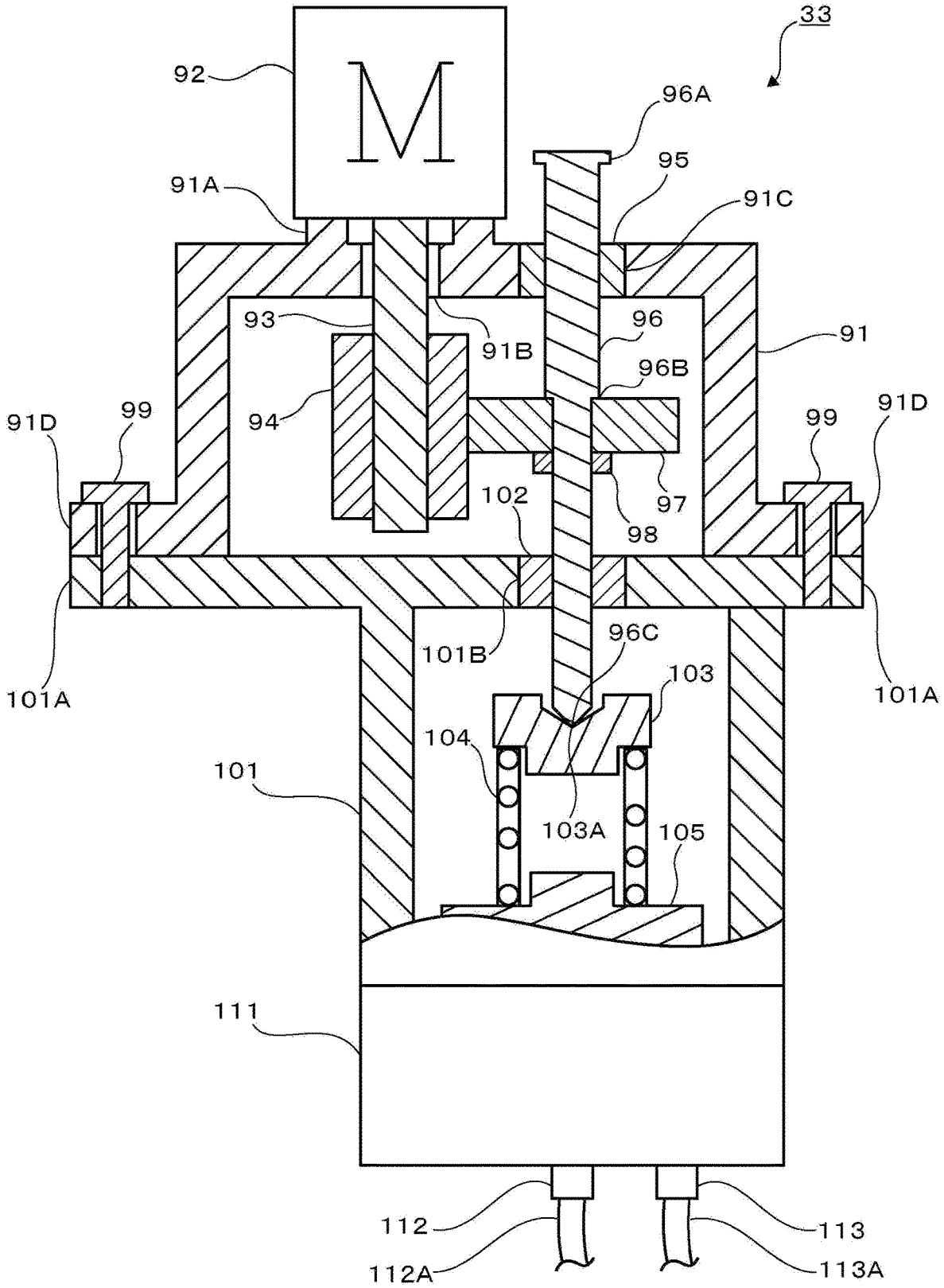
FIG. 14 is a view illustrating the structural arrangement of the pressure regulating valve of the inkjet recording apparatus according to a third embodiment.

FIG. 14 is a view illustrating the structural arrangement of the pressure regulating valve 33 of the inkjet recording apparatus according to the present example. With reference to FIG. 14, the pressure regulating valve 33 is provided with a joint (entrance) 112 to which the ink 7A pressurized by a pump (for feed) 24 is fed; a joint (exit) 113 to feed the ink 7A adjusted in pressure by the pressure regulating valve 33 to the nozzle 8; and a pressure adjusting base 111 internally having a pressure adjustment mechanism (not shown in the drawing). A tube (entrance) 112A and a tube (exit) 113A which are made from a solvent-proof PTFE material are connected to the joint (entrance) 112 and the joint (exit) 113 respectively.

The pressure adjusting base 111 is internally provided with the pressure adjustment mechanism 106 not shown in the drawing, and the pressure adjustment mechanism 106 controls the pressure applied to the ink by the compression rate of a spring 104. A lower spring seat 105 to transmit spring compression load to the pressure adjustment mechanism 106 and an upper spring seat 103 to transmit load to the spring 104 are provided in the periphery of the spring 104. Then, a pressure adjustment segment housing 101 is built in the pressure adjusting base 111 such that it encloses the upper spring seat 103, the spring 104 and the lower spring seat 105.

As to the pressure adjustment segment housing 101, a driving segment housing 91 is provided to the side opposed to the pressure adjusting base 111 thereof, and the pressure adjustment segment housing 101 is fixed to the driving segment housing 91 in such a manner that an upper fixing portion 101A formed on the outer circumference of the pressure adjustment segment housing 101 and a lower fixing portion 91D formed on the outer circumference of the driving segment housing 91 are engaged with each other and a fixing screw 99 is screwed in the mutually engaged portion.

Then, the driving segment housing 91 is provided with a pressure adjustment shaft 96 to transmit load to the spring 104. The pressure adjustment shaft 96 is formed with a tip end portion 96C which is tapered off to apply load to the upper spring seat 103 lest that its center axis is displaced, in which the tip end portion 96C is engaged with a pressure adjustment shaft tip end receiving portion 103A formed on the upper spring seat 103. Further, the pressure adjustment shaft 96 is provided with a pressure adjustment shaft gear 97 within the driving segment housing 91, and the pressure adjustment shaft gear 97 is fixed with sandwiched between a stepped portion 96B formed on the pressure adjustment shaft 96 and a gear fixing member 98.

As to the pressure regulating valve 33, with regard to the upper and lower sides of the pressure adjustment shaft gear 97, in order to prevent the pressure adjustment shaft 96 from being rotationally displaced around its center axis, a lower bearing 102 built in a lower pressure adjustment shaft passage hole 101B and an upper bearing 95 built in an upper pressure adjustment shaft passage hole 91C are provided. A motor 92 is built in the driving segment housing 91 through a motor fixing portion 91A, and the motor 92 is provided with a motor rotary shaft 93 to transmit rotational force.

Then, the motor rotary shaft 93 passes through a motor rotary shaft passage hole 91B of the driving segment housing 91 so as to enter into the driving segment housing 91, in which a motor gear 94 which is a driving gear is built in the motor rotary shaft 93. The motor gear 94 is built in the motor rotary shaft 93 such that it is engaged with the pressure adjustment shaft gear 97, and the pressure regulating valve 33 adjusts the pressure applied to the ink 7A to be fed to the nozzle 8 by driving the motor 92 so as to make the pressure adjustment shaft 96 axially move up and down and the compression rate of the spring 104 varied. Further, the pressure adjustment shaft 96 is formed with a stopper portion 96A lest that it compresses the spring 104 more than necessary, in which when the stopper portion 96A makes contact with the driving segment housing 91, the motor 92 halts due to the shortage of its torque, of which the inkjet recording apparatus 400 advises an operator by displaying an alarm.

In this regard, the pressure adjustment shaft gear 97 has a shorter gear portion with respect to the axial direction of the pressure adjustment shaft 96 compared with the motor gear 94, thereby, allowing making the driving segment housing 91 smaller in size. Further, the pressure adjustment shaft gear 97 has a larger diameter of the gear portion compared with the motor gear 94, thereby, allowing fine pressure adjustment to be feasible.

In view of the foregoing, according to the present example, it allows an inkjet recording apparatus which enables the pressure applied to the ink to be automatically adjusted to a target value based on the phase search determination results of the first electric charge detection section (phase sensor A) 61 and the second electric charge detection section (phase sensor B) 69 or the calculated results of the flying speed of the ink particles 7C to be provided.

Further, according to the present example, it allows an inkjet recording apparatus which enables a value of the pressure applied to the ink set through the input by an operator at the manipulation display unit and a value of the pressure applied to the ink to be controlled each and every type of ink to be automatically adjusted to be provided.

It shall be appreciated that the present invention is not limited to the above-described examples, but can be modified into various manners. For example, some of the features according to a certain example may be replaced with those of the other examples or the features of the other examples may be added to those of a certain example. Additionally, another feature may be added to some of features according to each example or some of such features may be replaced with another feature by deletion.

What is claimed is:

1. An inkjet recording apparatus comprising:

an ink receptacle in which a printing ink for an object to be printed is received;

a nozzle which is connected to the ink receptacle and from which the ink fed under pressure is discharged;

an electrification electrode to make ink particles discharged from the nozzle electrically charged;

an electrification signal generation unit to generate an electrification signal to make the electrification electrode electrically charged;

deflection electrodes to make the ink particles electrically charged by the electrification electrode deflect;

a gutter to recover the ink unused for the printing;

a control unit to control operations of the inkjet recording apparatus as a whole;

a first electric charge detection section to detect an amount of electric charge in accordance with the electrically charged ink particles between the electrification electrode and the deflection electrodes;

a second electric charge detection section to detect an amount of electric charge of the ink flowing within the gutter; and a determination section to determine a level of the amount of electric charge detected by the second electric charge detection section;

wherein the control unit stops the ink from being jetted from the nozzle when the control unit determines that the level does not go beyond a threshold set by the determination section.

2. The inkjet recording apparatus according to claim 1, wherein the second electric charge detection section is disposed farther downstream where the ink is recovered than a location where the ink particles drop with respect to the gutter.

3. The inkjet recording apparatus according to claim 1, wherein the control unit controls a timing when the electrification signal is generated by the electrification signal generation unit based on a detection result according to the first electric charge detection section.

4. The inkjet recording apparatus according to claim 1, wherein the control unit makes a comparison between a value of the amount of electric charge detected by the first electric charge detection section and a value of the amount of electric charge detected by the second electric charge detection section as well as a comparison between a timing when the electric charge is detected by the first electric charge detection section and a timing when the electric charge is detected by the second electric charge detection section; and adjusts pressure applied to the ink to be fed to the nozzle based on a result of the comparisons.

5. The inkjet recording apparatus according to claim 1, wherein the control unit makes a comparison between a value of the amount of electric charge detected by the first electric charge detection section and a value of the amount of electric charge detected by the second electric charge detection section as well as a comparison between a timing when the electric charge is detected by the first electric charge detection section and a timing when the electric charge is detected by the second electric charge detection section; and adjusts a temperature of the ink to be fed to the nozzle based on a result of the comparisons.

6. The inkjet recording apparatus according to claim 1, wherein the control unit makes a comparison between a value of the amount of electric charge detected by the first electric charge detection section and a value of the amount of electric charge detected by the second electric charge detection section as well as a comparison between a timing when the electric charge is detected by the first electric charge detection section and a timing when the electric charge is detected by the second electric charge detection section; and adjusts viscosity of the ink to be fed to the nozzle based on a result of the comparisons.

7. The inkjet recording apparatus according to claim 1, wherein all the ink particles are not electrically charged, but at least one non-charged ink particle intervenes between the ink particles electrically charged in accordance with the electrification in terms of the amount of electric charge detected by the first electric charge detection section.

8. An inkjet recording apparatus comprising:

an ink receptacle in which a printing ink for an object to be printed is received;

a nozzle which is connected to the ink receptacle and from which the ink fed under pressure is discharged;

an electrification electrode to subject the ink discharged from the nozzle to electrification;

deflection electrodes to make the ink subjected to the electrification by the electrification electrode deflect;

a gutter to recover the ink unused for the printing; and an electric charge detection section to detect an amount of electric charge in accordance with the electrification between the electrification electrode and the deflection electrodes, wherein the electric charge detection section is formed with an insulator between a sensor for electric charge detection and an ink beam discharged from the nozzle; and the sensor for electric charge detection is fixed in a state where the sensor makes contact with the insulator.

9. The inkjet recording apparatus according to claim 8, wherein the electric charge detection section is pushed by an elastic member provided on a side opposed to the insulator for the sensor for electric charge detection so as to be brought into contact with the insulator.

10. An inkjet recording apparatus comprising:

an ink receptacle in which a printing ink for an object to be printed is received;

a feeding pump which suctions the ink through a piping from the ink receptacle and feeds the ink under pressure to a nozzle to discharge the ink;

a pressure regulating valve which is disposed between the feeding pump and the nozzle and adjusts pressure applied to the ink within a piping path;

a pressure sensor to detect the pressure applied to the ink;

an electrification electrode to subject the ink discharged from the nozzle to electrification;

deflection electrodes to make the ink subjected to the electrification by the electrification electrode deflect;

a gutter to recover the ink unused for the printing; and an electric charge detection section to detect an amount of electric charge in accordance with the electrification, wherein the pressure regulating valve is provided with a pressure adjustment shaft, a pressure adjustment shaft gear integrally rotating with the pressure adjustment shaft, a driving gear disposed in a state where the driving gear is engaged with the pressure adjustment shaft gear, and a driving motor for rotating the driving gear.

11. The inkjet recording apparatus according to claim 10, wherein frontal and rear sides of the pressure adjustment shaft are respectively retained with a bearing with respect to the pressure adjustment shaft gear.

12. The inkjet recording apparatus according to claim 10, wherein the driving motor is subjected to driving control based on a detection result of the pressure sensor.

13. The inkjet recording apparatus according to claim 10, wherein the pressure adjustment shaft gear has a smaller thickness than the driving gear with respect to an axial direction of the pressure adjustment shaft.

* * * * *